US011069517B2

(12) United States Patent
Tate

(10) Patent No.: US 11,069,517 B2
(45) Date of Patent: Jul. 20, 2021

(54) PHYSICAL ISOLATION OF ADDUCTS AND OTHER COMPLICATING FACTORS IN PRECURSOR ION SELECTION FOR IDA

(71) Applicant: DH TECHNOLOGIES DEVELOPMENT PTE. LTD., Singapore (SG)

(72) Inventor: Stephen Alexander Tate, Barrie (CA)

(73) Assignee: DH Technologies Development Pte. Ltd., Singapore (SG)

( * ) Notice: Subject to any disclaimer, the term of this patent is extended or adjusted under 35 U.S.C. 154(b) by 32 days.

(21) Appl. No.: 16/487,079

(22) PCT Filed: Feb. 1, 2018

(86) PCT No.: PCT/IB2018/050626
§ 371 (c)(1),
(2) Date: Aug. 19, 2019

(87) PCT Pub. No.: WO2018/154400
PCT Pub. Date: Aug. 30, 2018

(65) Prior Publication Data

US 2020/0013609 A1 Jan. 9, 2020

Related U.S. Application Data

(60) Provisional application No. 62/462,066, filed on Feb. 22, 2017.

(51) Int. Cl.
*H01J 49/00* (2006.01)

(52) U.S. Cl.
CPC ..... *H01J 49/0036* (2013.01); *H01J 49/004* (2013.01); *H01J 49/0031* (2013.01)

(58) Field of Classification Search
CPC .. H01J 49/004; H01J 49/0031; H01J 49/0036; H01J 49/0027
See application file for complete search history.

(56) References Cited

U.S. PATENT DOCUMENTS

2012/0122077 A1 5/2012 Hughes et al.
2014/0346341 A1 11/2014 Giles et al.
(Continued)

FOREIGN PATENT DOCUMENTS

WO 2016125061 A1 8/2016

OTHER PUBLICATIONS

International Search Report and Written Opinion for PCT/IB2018/050626, dated May 11, 2018.

*Primary Examiner* — Eliza W Osenbaugh-Stewart
(74) *Attorney, Agent, or Firm* — John R. Kasha; Kelly L. Kasha; Kasha Law LLC

(57) ABSTRACT

A system is disclosed for identifying precursor ions originating from an ion source device. A mass filter filters an ion beam by using a series of overlapping precursor ion mass selection windows across the precursor ion mass range. A mass analyzer analyzes the precursor ions of each precursor ion mass selection window of the series, producing a plurality of precursor ion spectra for the precursor ion mass range. A precursor ion is selected from the spectra. The intensities for the selected precursor ion are retrieved from the spectra and a trace is produced that describes how the intensity of the selected precursor ion varies with the location of the precursor ion mass selection window. The selected precursor ion is identified as a precursor ion originating from the ion source device if the trace includes a nonzero intensity for the m/z value of the selected precursor ion.

14 Claims, 18 Drawing Sheets

(56) References Cited

U.S. PATENT DOCUMENTS

| | | | | |
|---|---|---|---|---|
| 2016/0032933 | A1 | 2/2016 | Simonsen | |
| 2016/0086783 | A1* | 3/2016 | Cox | H01J 49/0036 250/282 |
| 2016/0233077 | A1 | 8/2016 | Hager et al. | |
| 2016/0268111 | A1 | 9/2016 | Bloomfield et al. | |
| 2019/0228957 | A1* | 7/2019 | Ivosev | H01J 49/0081 |

* cited by examiner

100

1200

PHYSICAL ISOLATION OF ADDUCTS AND OTHER COMPLICATING FACTORS IN PRECURSOR ION SELECTION FOR IDA

CROSS REFERENCE TO RELATED APPLICATION

This application claims the benefit of U.S. Provisional Patent Application Ser. No. 62/462,066, filed Feb. 22, 2017, the content of which is incorporated by reference herein in its entirety.

INTRODUCTION

The teachings herein relate to controlling a mass spectrometer to perform a precursor ion survey scan that filters out fragments or adducts of precursor ions. More particularly the teachings herein relate to systems and methods for controlling a mass spectrometer to perform a scanning sequential windowed precursor ion selection and mass analysis that filters out fragments or adducts of precursor ions. The systems and methods herein can be performed in conjunction with a processor, controller, or computer system, such as the computer system of FIG. 1.

Survey Scan Contaminants

The isolation of precursor ions in information dependent analysis (IDA), which is described below, is based on a series of heuristic properties. The isolation of precursor ions occurs essentially on an intensity ranked list that allows for the most intense precursor ions to be fragmented first. However, there is no knowledge of the origin of the precursor ions prior to their selection except in the case of multiply charged species where multiply charged forms of the same species are ignored.

It is known that the precursor ion survey scans, such as time-of-flight mass spectrometry (TOF-MS) survey scans, also include ions that are either fragments (pieces) or adducts (additions) of the precursor ions. These fragment or adduct ions can confound a mass spectrometry identification experiment by being selected for mass spectrometry/mass spectrometry (MS/MS) fragmentation. The nature of the fragment ions, adduct ions or other ion forms may be sample related, but there is a growing evidence that they are also created within the mass spectrometry (MS) ion path.

Identifying fragments or adducts of the precursor ions in a precursor ion survey scan increases the level of noise in the detection of the compounds of interest. This increased noise is caused by the concurrent fragmentation of these fragment and adduct ions that fall within the survey scan range. This concurrent fragmentation of fragment and adduct ions is essentially a re-fragmenting of the same precursor ions causing a decrease in the number of "real" compound identifications that can be performed.

Tandem Mass Spectrometry Background

Scanning sequential windowed acquisition (SWATH) is a tandem mass spectrometry method. In general, tandem mass spectrometry, or MS/MS, is a well-known technique for analyzing compounds. Tandem mass spectrometry involves ionization of one or more compounds from a sample, selection of one or more precursor ions of the one or more compounds, fragmentation of the one or more precursor ions into fragment or product ions, and mass analysis of the product ions.

Tandem mass spectrometry can provide both qualitative and quantitative information. The product ion spectrum can be used to identify a molecule of interest. The intensity of one or more product ions can be used to quantitate the amount of the compound present in a sample.

A large number of different types of experimental methods or workflows can be performed using a tandem mass spectrometer. Three broad categories of these workflows are, targeted acquisition, information dependent acquisition (IDA) or data-dependent acquisition (DDA), and data-independent acquisition (DIA).

In a targeted acquisition method, one or more transitions of a precursor ion to a product ion are predefined for a compound of interest. As a sample is being introduced into the tandem mass spectrometer, the one or more transitions are interrogated during each time period or cycle of a plurality of time periods or cycles. In other words, the mass spectrometer selects and fragments the precursor ion of each transition and performs a targeted mass analysis for the product ion of the transition. As a result, an intensity (a product ion intensity) is produced for each transition. Targeted acquisition methods include, but are not limited to, multiple reaction monitoring (MRM) and selected reaction monitoring (SRM).

In an IDA method, a user can specify criteria for performing an untargeted mass analysis of product ions, while a sample is being introduced into the tandem mass spectrometer. For example, in an IDA method a precursor ion or mass spectrometry (MS) survey scan is performed to generate a precursor ion peak list. The user can select criteria to filter the peak list for a subset of the precursor ions on the peak list. MS/MS is then performed on each precursor ion of the subset of precursor ions. A product ion spectrum is produced for each precursor ion. MS/MS is repeatedly performed on the precursor ions of the subset of precursor ions as the sample is being introduced into the tandem mass spectrometer.

In proteomics and many other sample types, however, the complexity and dynamic range of compounds are very large. This poses challenges for traditional targeted and IDA methods, requiring very high-speed MS/MS acquisition to deeply interrogate the sample in order to both identify and quantify a broad range of analytes.

As a result, DIA methods, the third broad category of tandem mass spectrometry, were developed. These DIA methods have been used to increase the reproducibility and comprehensiveness of data collection from complex samples. DIA methods can also be called non-specific fragmentation methods. In a traditional DIA method, the actions of the tandem mass spectrometer are not varied among MS/MS scans based on data acquired in a previous precursor or product ion scan. Instead, a precursor ion mass range is selected. A precursor ion mass selection window is then stepped across the precursor ion mass range. All precursor ions in the precursor ion mass selection window are fragmented and all of the product ions of all of the precursor ions in the precursor ion mass selection window are mass analyzed.

The precursor ion mass selection window used to scan the mass range can be very narrow so that the likelihood of multiple precursors within the window is small. This type of DIA method is called, for example, $MS/MS^{ALL}$. In an $MS/MS^{ALL}$ method, a precursor ion mass selection window of about 1 amu is scanned or stepped across an entire mass range. A product ion spectrum is produced for each 1 amu precursor mass window. The time it takes to analyze or scan the entire mass range once is referred to as one scan cycle. Scanning a narrow precursor ion mass selection window across a wide precursor ion mass range during each cycle, however, is not practical for some instruments and experiments.

As a result, a larger precursor ion mass selection window, or selection window with a greater width, is stepped across the entire precursor mass range. This type of DIA method is called, for example, SWATH acquisition. In a SWATH acquisition, the precursor ion mass selection window stepped across the precursor mass range in each cycle may have a width of 5-25 amu, or even larger. Like the $MS/MS^{ALL}$ method, all the precursor ions in each precursor ion mass selection window are fragmented, and all of the product ions of all of the precursor ions in each mass selection window are mass analyzed. However, because a wider precursor ion mass selection window is used, the cycle time can be significantly reduced in comparison to the cycle time of the $MS/MS^{ALL}$ method. Or, for liquid chromatography (LC), the accumulation time can be increased. Generally, for LC, the cycle time is defined by an LC peak. Enough points (intensities as a function of cycle time) must be obtained across an LC peak to determine its shape. When the cycle time is defined by the LC, the number of experiments or mass spectrometry scans that can be performed in a cycle defines how long each experiment or scan can accumulate ion observations. As a result, using a wider precursor ion mass selection window can increase the accumulation time.

U.S. Pat. No. 8,809,770 describes how SWATH acquisition can be used to provide quantitative and qualitative information about the precursor ions of compounds of interest. In particular, the product ions found from fragmenting a precursor ion mass selection window are compared to a database of known product ions of compounds of interest. In addition, ion traces or extracted ion chromatograms (XICs) of the product ions found from fragmenting a precursor ion mass selection window are analyzed to provide quantitative and qualitative information.

However, identifying compounds of interest in a sample analyzed using SWATH acquisition, for example, can be difficult. It can be difficult because either there is no precursor ion information provided with a precursor ion mass selection window to help determine the precursor ion that produces each product ion, or the precursor ion information provided is from a mass spectrometry (MS) observation that has a low sensitivity. In addition, because there is little or no specific precursor ion information provided with a precursor ion mass selection window, it is also difficult to determine if a product ion is convolved with or includes contributions from multiple precursor ions within the precursor ion mass selection window.

Scanning SWATH Background

As a result, a method of scanning the precursor ion mass selection windows in SWATH acquisition, called scanning SWATH, was developed. Essentially, in scanning SWATH, a precursor ion mass selection window is scanned across a mass range so that successive windows have large areas of overlap and small areas of non-overlap. This scanning makes the resulting product ions a function of the scanned precursor ion mass selection windows. This additional information, in turn, can be used to identify the one or more precursor ions responsible for each product ion.

Scanning SWATH has been described in International Publication No. WO 2013/171459 A2 (hereinafter "the '459 Application"). In the '459 Application, a precursor ion mass selection window or precursor ion mass selection window of 25 Da is scanned with time such that the range of the precursor ion mass selection window changes with time. The timing at which product ions are detected is then correlated to the timing of the precursor ion mass selection window in which their precursor ions were transmitted.

The correlation is done by first plotting the mass-to-charge ratio (m/z) of each product ion detected as a function of the precursor ion m/z values transmitted by the quadrupole mass filter. Since the precursor ion mass selection window is scanned over time, the precursor ion m/z values transmitted by the quadrupole mass filter can also be thought of as times. The start and end times at which a particular product ion is detected are correlated to the start and end times at which its precursor is transmitted from the quadrupole. As a result, the start and end times of the product ion signals are used to determine the start and end times of their corresponding precursor ions.

Scanning SWATH has also been described in International Publication No. WO 2015/056066 A1 (hereinafter "the '066 Application"). The '066 Application improves the accuracy of the correlation of product ions to their corresponding precursor ions by combining product ion spectra from successive groups of the overlapping rectangular precursor ion mass selection windows. Product ion spectra from successive groups are combined by successively summing the intensities of the product ions in the product ion spectra. This summing produces a function that can have a shape that is non-constant with precursor mass. The shape describes product ion intensity as a function of precursor mass. A precursor ion is identified from the function calculated for a product ion.

Systems and methods for identifying one or more precursor ions corresponding to a product ion in scanning SWATH data are further described in U.S. Provisional Patent Application No. 62/366,526 (hereinafter "the '526 Application"). Scanning SWATH is performed, producing a series of overlapping windows across the precursor ion mass range. Each overlapping window is fragmented and mass analyzed, producing a plurality of product ion spectra for the mass range. A product ion is selected from the spectra. Intensities for the selected product ion are retrieved for at least one scan across the mass range producing a trace of intensities versus precursor ion m/z. A matrix multiplication equation is created that describes how one or more precursor ions correspond to the trace for the selected product ion. The matrix multiplication equation is solved for one or more precursor ions corresponding to the selected product ion using a numerical method.

As described above, sequential windowed acquisition (SWATH) is a tandem mass spectrometry technique that allows a mass range to be scanned within a time interval using multiple precursor ion scans of adjacent or overlapping precursor ion mass selection windows. A mass filter selects each precursor mass window for fragmentation. A high-resolution mass analyzer is then used to detect the product ions produced from the fragmentation of each precursor mass window. SWATH allows the sensitivity of precursor ion scans to be increased without the traditional loss in specificity.

Unfortunately, however, the increased sensitivity that is gained through the use of sequential precursor mass windows in the SWATH method is not without cost. Each of these precursor mass windows can contain many other precursor ions, which confounds the identification of the correct precursor ion for a set of product ions. Essentially, the exact precursor ion for any given product ion can only be localized to a precursor mass window.

FIG. 2 is an exemplary plot 200 of a single precursor ion mass selection window that is typically used in a SWATH acquisition. Precursor ion mass selection window 210 transmits precursor ions with m/z values between $M_1$ and $M_2$, has set mass or center mass 215, and has sharp vertical edges 220 and 230. The SWATH precursor ion mass selection window width is $M_2$-$M_1$. The rate at which precursor ion mass selection window 210 transmits precursor ions is constant with respect to precursor m/z. Note that one skilled in the art can appreciate that the terms "m/z" and "mass" can be used interchangeably. The mass is easily obtained from the m/z value by multiplying the m/z value by the charge.

FIG. 3 is an exemplary series 300 of plots showing how product ions are correlated to precursor ions in conventional SWATH. Plot 310 shows a precursor ion mass range from 100 m/z to 300 m/z. When this precursor ion mass range is mass filtered and analyzed using a precursor ion scan, the precursor ion mass spectrum shown in plot 310 is found. The precursor ion mass spectrum includes precursor ion peaks 311, 312, 313, and 314, for example.

In conventional SWATH acquisition, a series of precursor ion mass selection windows, like precursor ion mass selection window 210 of FIG. 2, are selected across a precursor ion mass range. For example, ten precursor ion mass selection windows each of width 20 m/z can be selected for the precursor ion mass range from 100 m/z to 300 m/z shown in plot 310 of FIG. 3. Plot 320 shows three of the 10 precursor ion mass selection windows, 321, 322, and 323, for the precursor ion mass range from 100 m/z to 300 m/z. Note that the precursor ion mass selection windows of plot 320 do not overlap. In other conventional SWATH scans, the precursor ion mass selection windows can overlap.

For each conventional SWATH scan, the precursor ion mass selection windows are sequentially fragmented and mass analyzed. As a result, for each scan, a product ion spectrum is produced for each precursor ion mass selection window. Plot 331 is the product ion spectrum produced for precursor ion mass selection window 321 of plot 320. Plot 332 is the product ion spectrum produced for precursor ion mass selection window 322 of plot 320. And, plot 333 is the product ion spectrum produced for precursor ion mass selection window 323 of plot 320.

The product ions of a conventional SWATH are correlated to precursor ions by locating the precursor ion mass selection window of each product ion, and determining the precursor ions of the precursor ion mass selection window from the precursor ion spectrum obtained from a precursor ion scan. For example, product ions 341, 342, and 343 of plot 331 are produced by fragmenting precursor ion mass selection window 321 of plot 320. Based on its location in the precursor ion mass range and the results from a precursor ion scan, precursor ion mass selection window 321 is known to include precursor ion 311 of plot 310. Since precursor ion 311 is the only precursor ion in precursor ion mass selection window 321 of plot 320, product ions 341, 342, and 343 of plot 331 are correlated to precursor ion 311 of plot 310.

Similarly, product ion 361 of plot 333 is produced by fragmenting precursor ion mass selection window 323 of plot 320. Based on its location in the precursor ion mass range and the results from a precursor ion scan, precursor ion mass selection window 323 is known to include precursor ion 314 of plot 310. Since precursor ion 314 is the only precursor ion in precursor ion mass selection window 323 of plot 320, product ion 361 is correlated to precursor ion 314 of plot 310.

The correlation, however, becomes more difficult when a precursor ion mass selection window includes more than one precursor ion and those precursor ions may produce the same or a similar product ion. In other words, when interfering precursor ions occur in the same precursor ion mass selection window, it is not possible to correlate the common product ions to the interfering precursor ions without additional information.

For example, product ions 351 and 352 of plot 332 are produced by fragmenting precursor ion mass selection window 322 of plot 320. Based on its location in the precursor ion mass range and the results from a precursor ion scan, precursor ion mass selection window 322 is known to include precursor ions 312 and 313 of plot 310. As a result, product ions 351 and 352 of plot 332 can be from precursor ion 312 or 313 of plot 310. Further, precursor ions 312 and 313 may both be known to produce a product ion at or near the m/z of product ion 351. In other words, both precursor ions may provide contributions to product ion peak 351. As a result, the correlation of a product ion to a precursor ion or to a specific contribution from a precursor ion is made more difficult.

In conventional SWATH acquisition, chromatographic peaks, such as LC peaks, can also be used to improve the correlation. In other words, the compound of interest is separated over time and the SWATH acquisition is performed at a plurality of different elution or retention times. The retention times and/or the shapes of product and precursor ion chromatographic peaks are then compared to enhance the correlation. Unfortunately, however, because the sensitivity of the precursor ion scan is low, the chromatographic peaks of precursor ions may be convolved, further confounding the correlation.

In various embodiments, scanning SWATH provides additional information that is similar to that provided by chromatographic peaks, but with enhanced sensitivity. In scanning SWATH, overlapping precursor ion mass selection windows are used to correlate precursor and product ions. For example, a single precursor ion mass selection window such as precursor ion mass selection window 210 of FIG. 2 is shifted in small steps across a precursor mass range so that there is a large overlap between successive precursor ion mass selection windows. As the amount of overlap between precursor ion mass selection windows is increased, the accuracy in correlating the product ions to precursor ions is also increased.

Essentially, when the intensities of product ions produced from precursor ions filtered by the overlapping precursor ion mass selection windows are plotted as a function of the precursor ion mass selection window moving across the precursor mass range, each product ion has an intensity for the same precursor mass range that its precursor ion has been transmitted. In other words, for a rectangular precursor ion mass selection window (such as precursor ion mass selection window 210 of FIG. 2) that transmits precursor ions at a constant rate with respect to precursor mass, the edges (such as edges 220 and 230 of FIG. 2) define a unique boundary of both precursor ion mass selection and product ion intensity as the precursor ion mass selection is stepped across the precursor mass range.

FIG. 4 is an exemplary plot 400 of a precursor ion mass selection window 410 that is shifted or scanned across a precursor ion mass range in order to produce overlapping precursor ion mass selection windows. Precursor ion mass selection window 410, for example, starts to transmit precursor ion with m/z value 420 when leading edge 430 reaches precursor ion with m/z value 420. As precursor ion mass selection window 410 is shifted across the m/z range, the precursor ion with m/z value 420 is transmitted until trailing edge 440 reaches m/z value 420.

When the intensities of the product ions from the product ion spectra produced by the overlapping windows are plotted, for example, as a function of the m/z value of leading edge 430, any product ion produced by the precursor ion with m/z value 420 would have an intensity between m/z value 420 and m/z value 450 of leading edge 430. One skilled in the art can appreciate that the intensities of the product ions produced by the overlapping windows can be plotted as a function of the precursor ion m/z value based on any parameter of precursor ion mass selection window 410 including, but not limited to, trailing edge 440, set mass, center of gravity, or leading edge 430.

FIG. 5 is an exemplary series 500 of plots showing how product ions are correlated to precursor ions in scanning SWATH. Plot 510 is the same as plot 310 of FIG. 3. Plot 510 of FIG. 5 shows a precursor ion mass range from 100 m/z to 300 m/z. When this precursor ion mass range is mass filtered and analyzed using a precursor ion scan, the precursor ion mass spectrum shown in plot 510 is found. The precursor ion mass spectrum includes precursor ion peaks 311, 312, 313, and 314, for example.

In scanning SWATH, however, rather than selecting and then fragmenting and mass analyzing non-overlapping precursor ion mass selection windows across the mass range, a precursor ion mass selection window is quickly moved or scanned across the precursor ion mass range with large overlaps between windows in each scanning SWATH scan. For example, during scan 1, precursor ion mass selection window 521 of plot 520 extends from 100 m/z to 120 m/z. The fragmentation of precursor ion mass selection window 521 and mass analysis of the resulting fragments during scan 1 produces the product ions of plot 531. Product ions 541, 542, and 543 of plot 531 are known to correlate to precursor ion 311 of plot 510, because precursor ion 311 is the only precursor within precursor ion mass selection window 521 of plot 520. Note that plot 531 includes the same product ions as plot 331 of FIG. 3.

For scan 2, precursor ion mass selection window 521 is shifted 1 m/z as shown in plot 530. Precursor ion mass selection window 521 of plot 530 no longer includes precursor ion 311 of plot 510. However, precursor ion mass selection window 521 of plot 530 now includes precursor ion 312 of plot 510. The fragmentation of precursor ion mass selection window 521 and mass analysis of the resulting fragments during scan 2 produces the product ion of plot 532. Product ion 551 of plot 532 is known to correlate to precursor ion 312 of plot 510, because precursor ion 312 is the only precursor within precursor ion mass selection window 521 of plot 530. Note that product ion 551 of plot 532 has the same m/z value as product ion 351 of plot 332 of FIG. 3, but a different intensity. From plot 532 of FIG. 5, it is now known what portion of 351 of plot 332 of FIG. 3 is from precursor ion 312 of plot 510.

For scan 3, precursor ion mass selection window 521 is shifted another 1 m/z as shown in plot 540. Precursor ion mass selection window 521 of plot 540 now includes precursor ions 312 and 313 of plot 510. The fragmentation of precursor ion mass selection window 521 and mass analysis of the resulting fragments during scan 3 produces the product ions of plot 533. Because precursor ion mass selection window 521 of plot 540 includes precursor ions 312 and 313 of plot 510, product ions 551 and 552 of plot 533 can be from either or both precursor ions.

Note that plot 533 includes the same product ions as plot 332 of FIG. 3. However, due to the additional information from scanning SWATH correlation is now possible. As mentioned above, from plot 532 of FIG. 5, it is now known what portion of 351 of plot 332 of FIG. 3 is from precursor ion 312 of plot 510. In other words, when the leading edges of precursor ion mass selection window 521 reaches precursor ion 312 of plot 510 and the trailing edges of precursor ion mass selection window 521 no longer includes precursor ion 312 of plot 510, the contribution of precursor ion 312 of plot 510 is known.

In addition, comparing plots 532 and 533 of FIG. 5 determines the contributions of precursor ion 313 of plot 510. Note that once the leading edge of precursor ion mass selection window 521 reaches precursor ion 313 of plot 510, product ion 552 of plot 533 appears and the intensity of product ion 551 increases. Thus product ion 552 is correlated to precursor ion 313 of plot 510 and the additional intensity of product ion 551 is also correlated to precursor ion 313 of plot 510.

FIG. 6 is a diagram 600 showing how a product ion produced from a precursor ion that is filtered by overlapping precursor ion mass selection windows in a scanning SWATH acquisition can be plotted as a function of the precursor ion mass selection window moving across the precursor mass range. Plot 610 shows that there is a precursor ion 620 at m/z 630. Precursor ion mass selection window 641 is stepped across the precursor ion mass range from m/z 631 to m/z 633, resulting in overlapping rectangular precursor ion mass selection windows 640. Each window of precursor ion mass selection windows 640 is fragmented. The resulting product ions are then mass analyzed, producing a product ion mass spectrum (not shown) for each window of precursor ion mass selection windows 640.

FIG. 6 shows just one scan of precursor ion mass selection window 641 across precursor ion mass range from m/z 631 to m/z 633. However, precursor ion mass selection window 641 can be scanned across the precursor ion mass range from m/z 631 to m/z 633 multiple times, for example.

A product ion is selected from one of the product ion spectra produced. A product ion is selected, for example, that has a mass peak above a certain threshold.

The intensity of the product ion is then calculated as a function of the position of precursor ion mass selection window 641 by obtaining the intensity of the product ion from each product ion spectrum produced for each precursor ion mass selection window of precursor ion mass selection windows 640. The intensity of a selected product ion calculated as a function of the position of the precursor ion mass selection window can be called, for example, a quadrupole ion trace (QIT).

An exemplary QIT 660 calculated for a product ion is shown in plot 650. QIT 660 shows the intensities of the selected product ion obtained from each product ion spectrum produced for each precursor ion mass selection window of precursor ion mass selection windows 640. The intensities are plotted as a function of the leading edge of precursor ion mass selection windows 640. However, as described above, these intensities can be plotted as a function of any parameter of precursor ion mass selection windows 640 including, but not limited to, the trailing edge, set mass, leading edge, or scan time.

QIT 660 of plot 650 shows that the intensity of the selected product ion becomes non-zero when the leading edge of scanning precursor ion mass selection window 641 reaches m/z 630. It also shows that the intensity of the product ion returns to zero when the leading edge of the scanning precursor ion mass selection window passes m/z 632. In other words, QIT 660 has sharp leading and trailing edges corresponding to locations of scanning precursor ion mass selection window 641.

FIG. 6, shows that the leading and trailing edges of QIT 660 can be used to determine the corresponding precursor ion of the selected product ion. Essentially, the leading and trailing edges of QIT 660 mean that the precursor ion of the selected product ion must be in the precursor ion mass selection windows between these edges. Precursor ion mass selection windows 645 of precursor ion mass selection windows 640 have leading edges within these windows. Plot 610 shows that precursor ion 620 is the only precursor ion that can be in precursor ion mass selection windows 645. Therefore, the selected product ion with QIT 660 corresponds to precursor ion 620.

This leading and trailing edge analysis of a QIT was described in the '459 Application. Unfortunately, there are two problems with this type of analysis. First, as the '066 Application describes, most mass filters are unable to produce precursor ion mass selection windows with sharply defined edges. As a result, a calculated QIT is likewise unlikely to have sharply defined edges. Secondly, the product ion may be a result of two or more different precursor ions that have similar masses. In other words, the product ion intensity may be a convolution intensities produced from two or more interfering precursor ions.

FIG. 7 is a plot 700 of an exemplary quadrupole ion trace (QIT) calculated for a selected product ion that is produced from two interfering precursor ions using data from an actual scanning SWATH experiment. A comparison of plot 700 with plot 650 of FIG. 6 shows that an actual QIT does not have sharply defined edges. The comparison also shows the multiple levels of intensities caused by the two interfering precursor ions further complicates the determination of the corresponding precursor ions. As a result, methods other than simple edge detection are needed to accurately determine the corresponding precursor ions from a product ion QIT.

In the '526 Application, the corresponding precursor ions are determined from a product ion QIT using a system of linear equations. For example, each step of the precursor ion mass selection window across the mass range is represented by a linear equation. The unknown variables of each linear equation are the intensities of the precursor ion m/z values across the precursor ion mass range. The coefficients of each linear equation specify the position of the precursor ion mass selection window. The result of each equation is the value of the QIT at that particular step of the precursor ion mass selection window across the mass range. The corresponding precursor ions of a product ion QIT are found by solving the system of linear equations for the precursor ion intensity values across the precursor ion mass range (the unknown variables).

In various embodiments, the system of linear equations used to determine the corresponding precursor ions of a product ion QIT is represented as a matrix multiplication equation. For example, an n×m matrix is multiplied by a column matrix of length m producing a column matrix of length n. The n×m matrix represents the mass filter. The rows, n, are the locations of the precursor ion mass selection window across the precursor ion mass range. The columns, m, are the precursor ion m/z values across the precursor ion mass range. The elements of the n×m matrix represent the transmission (1) or non-transmission (0) by the precursor ion mass selection window at that location and precursor ion m/z value. The elements are known from the acquisition. This is how the mass filter scans the precursor ion mass selection window across the precursor ion mass range.

The rows, m, of the column matrix of length m correspond to the columns of the n×m matrix and are the precursor ion m/z values across the precursor ion mass range. The elements of the column matrix of length m are the intensities of the precursor ions at the precursor ion m/z value. These elements are unknown.

The rows, n, of the column matrix of length n correspond to the rows of the n×m matrix and are the locations of the precursor ion mass selection window across the precursor ion mass range. The elements of the column matrix of length n are the intensities of the product ion at locations of the precursor ion mass selection window across the precursor ion mass range that are known from the QIT calculated for a particular acquisition.

FIG. 8 is a diagram 800 showing a simplified example of how corresponding precursor ions are determined from a product ion QIT using a system of linear equations represented by a matrix multiplication equation. Plot 810 shows how precursor ion mass selection window 841 is scanned across a precursor ion mass range from an m/z of 1 to an m/z of 5. Precursor ions 821 and 822 are unknown.

A product ion is selected from the product ion spectra produced from scanning precursor ion mass selection window 841 across the precursor ion mass range from an m/z of 1 to an m/z of 5, fragmenting each window, and mass analyzing the product ions produced for each window. QIT 860 of plot 850 is the QIT calculated for the selected product ion. As described above, the actual QIT of the selected product ion will not have the sharp edges of QIT 860. In fact, the actual QIT of the selected product ion will look much more like QIT 510 of FIG. 5. However, QIT 860 is drawn with sharp edges to simplify the example.

In order to determine the precursor ions corresponding to QIT 860 a system of linear equations is calculated. This system is represented in the form of matrix multiplication equation 870. In equation 870, 9×5 mass filter matrix 871 is multiplied by precursor ion column matrix 872 of length 5 producing QIT column matrix 873 of length 9. The elements of mass filter matrix 871 are known from movements of precursor ion mass selection window 841 during the scan across the precursor ion mass range. QIT column matrix 873 is also known. It is calculated from the product ion spectra produced. Precursor ion column matrix 872 is unknown.

In various embodiments, a numerical method is applied to matrix multiplication equation 870 to solve for precursor ion column matrix 872. The solution for precursor ion column matrix 872 determines the corresponding precursor ions for QIT 860. For example, the solution for precursor ion column matrix 872 shows that the selected product ion with QIT 860 was produced from a precursor ion with intensity 2 at 2 m/z and a precursor ion with intensity 1 at 3 m/z. These precursor ions are ions 821 and 822, respectively, shown in plot 810.

In various embodiments, the numerical method applied to matrix multiplication equation 870 is non-negative least squares (NNLS).

FIG. 9 is an exemplary matrix multiplication equation 900 showing an experimental example of how corresponding precursor ions are determined from a product ion QIT. Matrix multiplication equation 900 includes quadrupole 1 (Q1) mass filter matrix 971, precursor ion column matrix 972, and QIT column matrix 973. Q1 mass filter matrix 971 is known from the acquisition and describes how the Q1 mass filter scan operates. Note that Q1 mass filter matrix 971 includes non-zero values along diagonal 980, corresponding to the sliding precursor ion mass selection window of scanning SWATH™.

QIT column matrix 973 includes the known or observed product ion intensities of the selected product ion as a function of Q1 or precursor ion mass or m/z. QIT column matrix 973 is represented in FIG. 9 by actual calculated QIT 990.

Precursor ion column matrix 972 is the unknown. Matrix multiplication equation 900 is solved for precursor ion column matrix 972. Precursor ion column matrix 972 includes the intensities of the precursor ions corresponding to the product ion for which QIT column matrix 973 is calculated. Precursor ion column matrix 972 is represented in FIG. 9 by a precursor ion spectrum that can be produced from precursor ion column matrix 972. When matrix multiplication equation 900 is solved, precursor ions 921 and 922 are found to correspond to QIT 990. Matrix multiplication equation 900 is solved using the NNLS numerical method.

SUMMARY

A system, method, and computer program product are disclosed for identifying precursor ions originating from an ion source device using a scanning sequential windowed precursor ion selection and mass analysis survey scan. All three embodiments include the following steps.

An ion source device ionizes and transforms a sample or compounds of interest from a sample into an ion beam. A mass filter receives the ion beam from the ion source device.

A processor instructs the mass filter to filter the ion beam by scanning a precursor ion mass selection window across a precursor ion mass range of interest in overlapping steps. This scanning of the precursor ion mass selection window produces a series of overlapping precursor ion mass selection windows. The processor also instructs the mass filter to transmit precursor ions from each precursor ion mass selection window of the series of overlapping precursor ion mass selection windows to a mass analyzer.

The processor instructs the mass analyzer to analyze the precursor ions of each precursor ion mass selection window of the series of overlapping precursor ion mass selection windows. A precursor ion spectrum is produced for each overlapping precursor ion mass selection window, and a plurality of precursor ion spectra are produced for the precursor ion mass range.

The processor receives the plurality of precursor ion spectra from mass analyzer 1030 and performs the following steps. (A) It selects a precursor ion from the plurality of precursor ion spectra that has an intensity above a predetermined threshold. (B) For the selected precursor ion, it retrieves the intensities of the selected precursor ion from the plurality of precursor ion spectra for at least one scan of the precursor ion mass selection window across the precursor ion mass range. Further, it produces a trace that describes how the intensity of the selected precursor ion varies with the location of the precursor ion mass selection window expressed as the precursor ion mass-to-charge ratio (m/z) of the precursor ion mass selection window as the precursor ion mass selection window is scanned across the precursor ion mass range. (C) It identifies the selected precursor ion as a precursor ion originating from the ion source device if the trace includes a nonzero intensity for the m/z value of the selected precursor ion.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
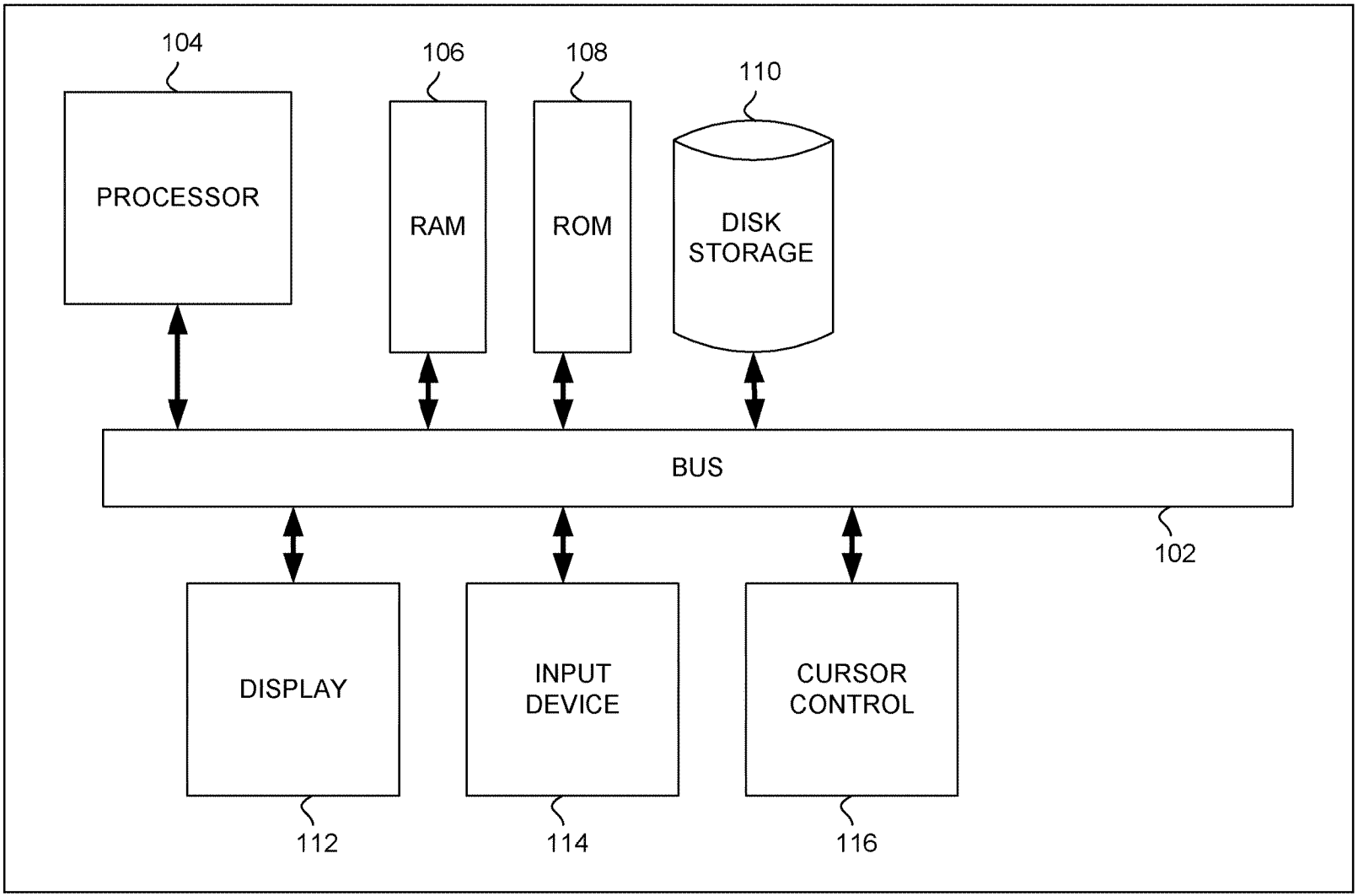
FIG. 1 is a block diagram that illustrates a computer system, upon which embodiments of the present teachings may be implemented.
Figure 2:
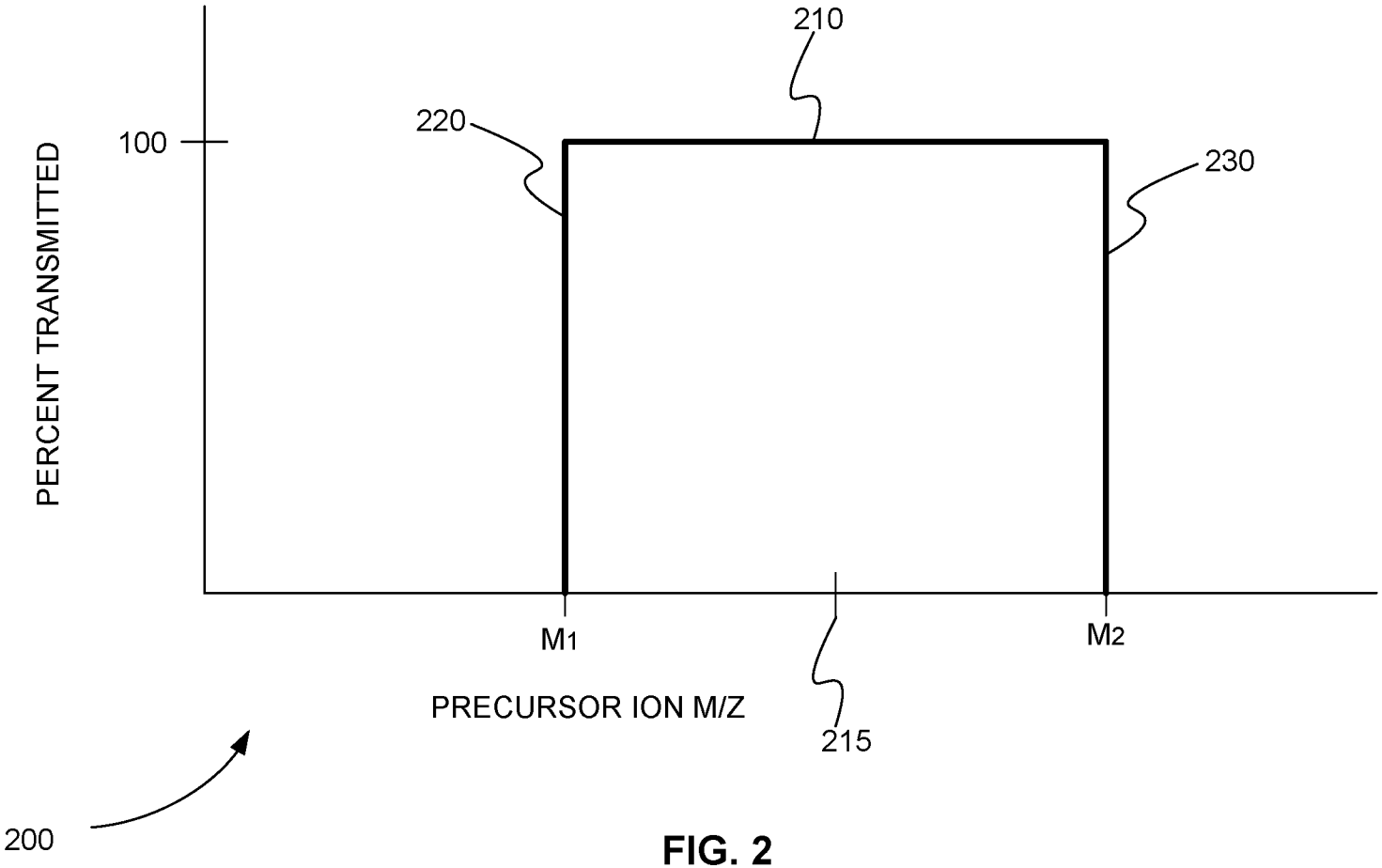
FIG. 2 is an exemplary plot of a single precursor ion mass selection window that is typically used in a SWATH acquisition.
Figure 3:
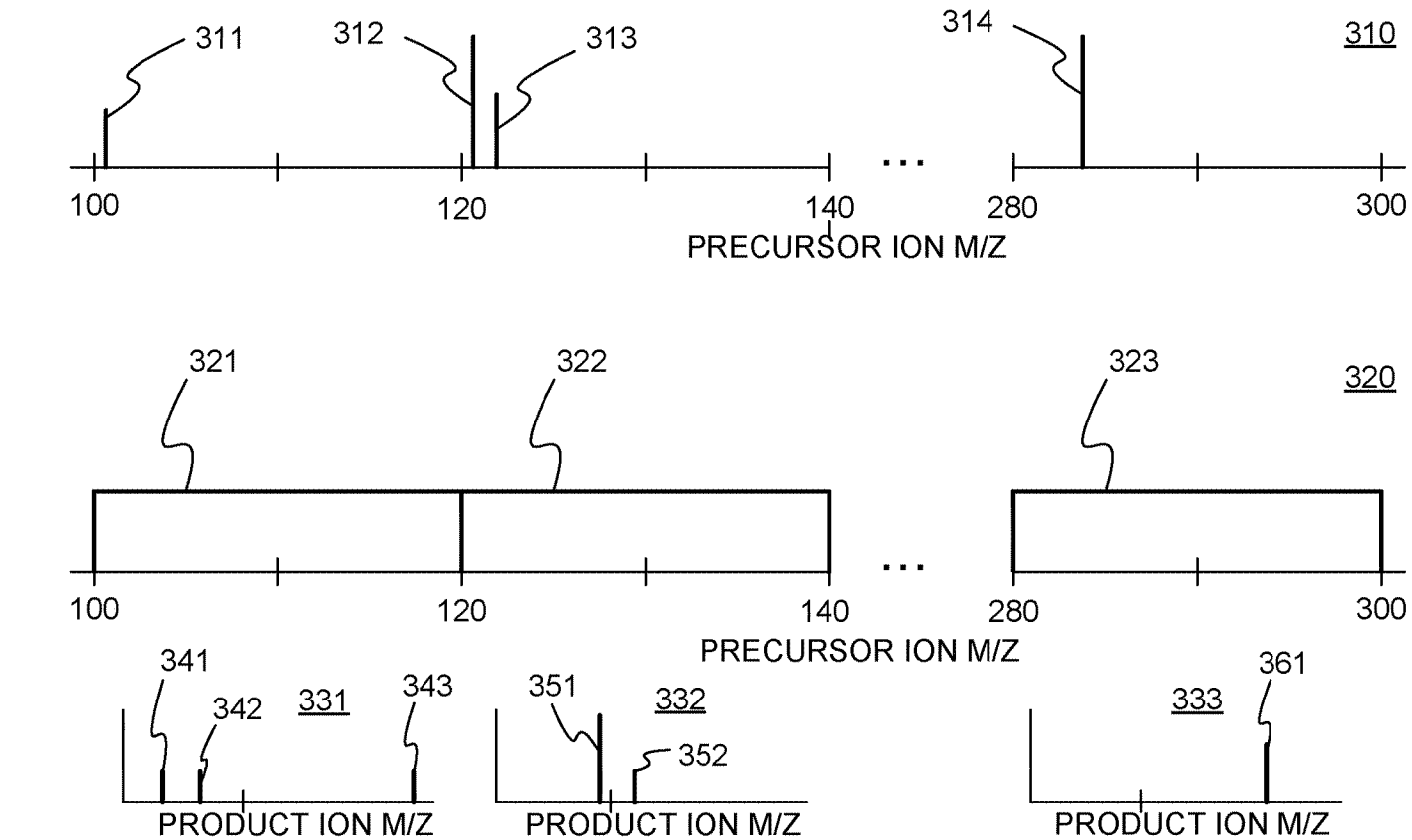
(PRIOR ART) FIG. 3
FIG. 3 is an exemplary series 3 of plots showing how product ions are correlated to precursor ions in conventional SWATH.
Figure 4:
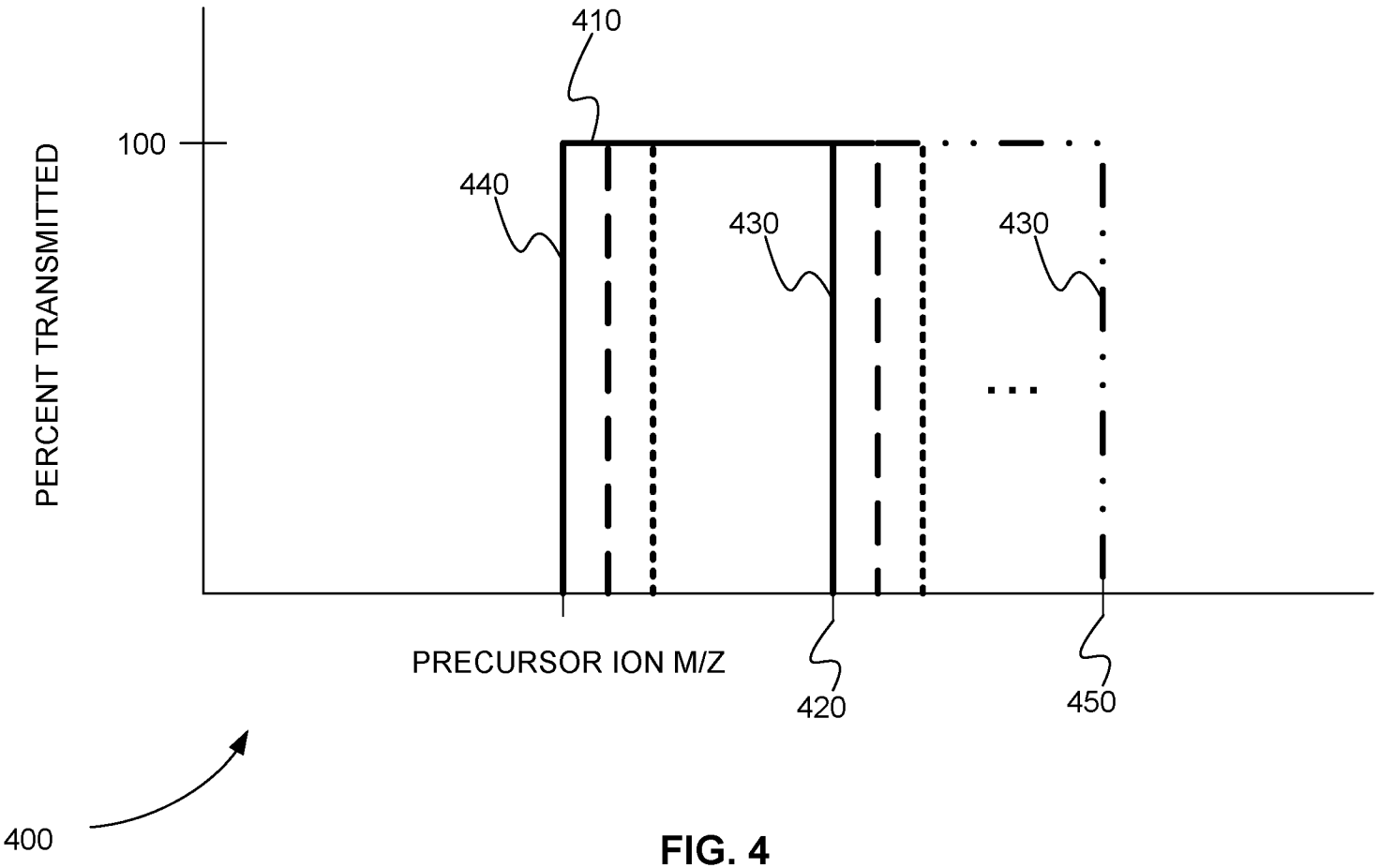
FIG. 4 is an exemplary plot of a precursor ion mass selection window that is shifted or scanned across a precursor ion mass range in order to produce overlapping precursor ion mass selection windows.
Figure 5:
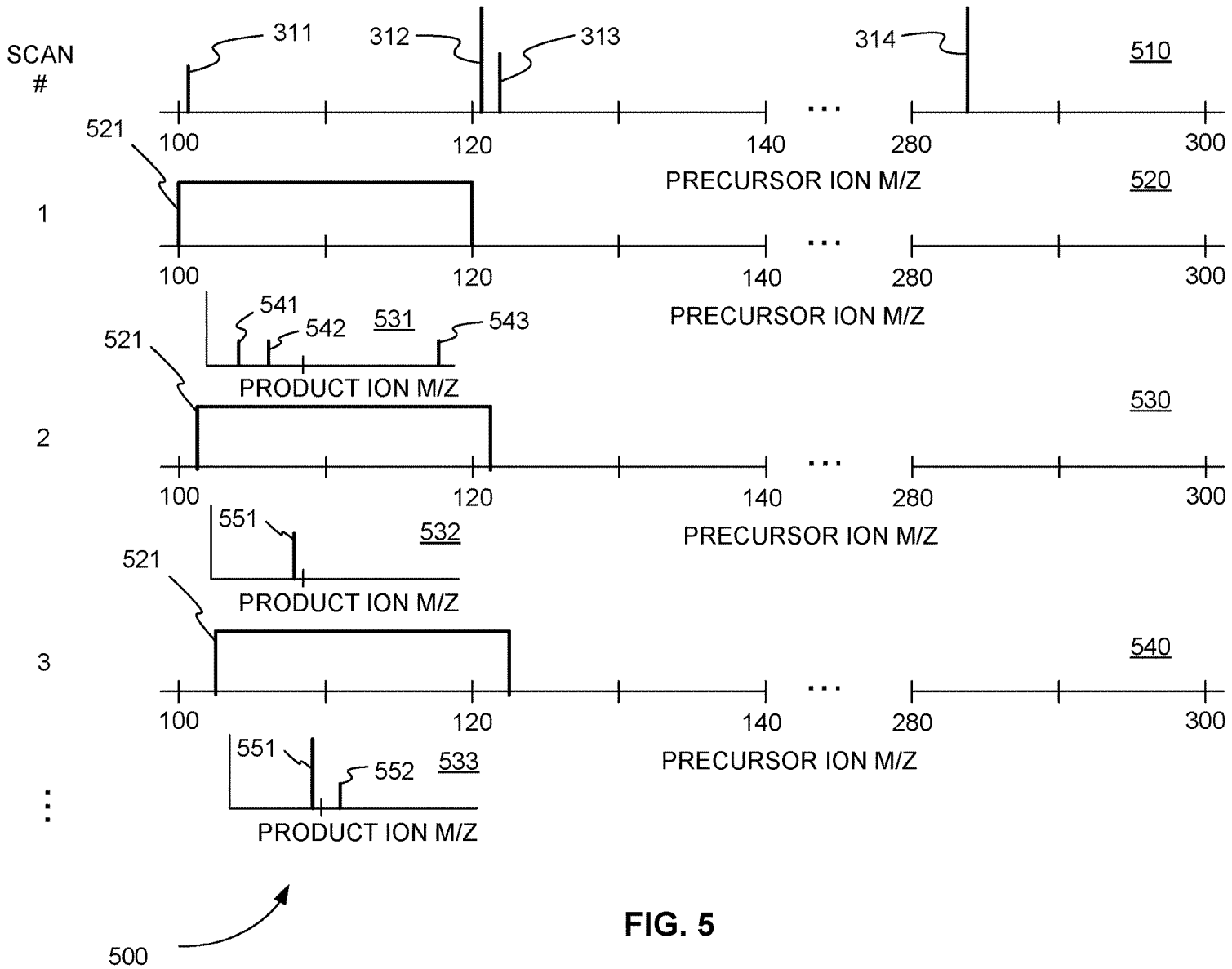
FIG. 5 is an exemplary series of plots showing how product ions are correlated to precursor ions in scanning SWATH.
Figure 6:
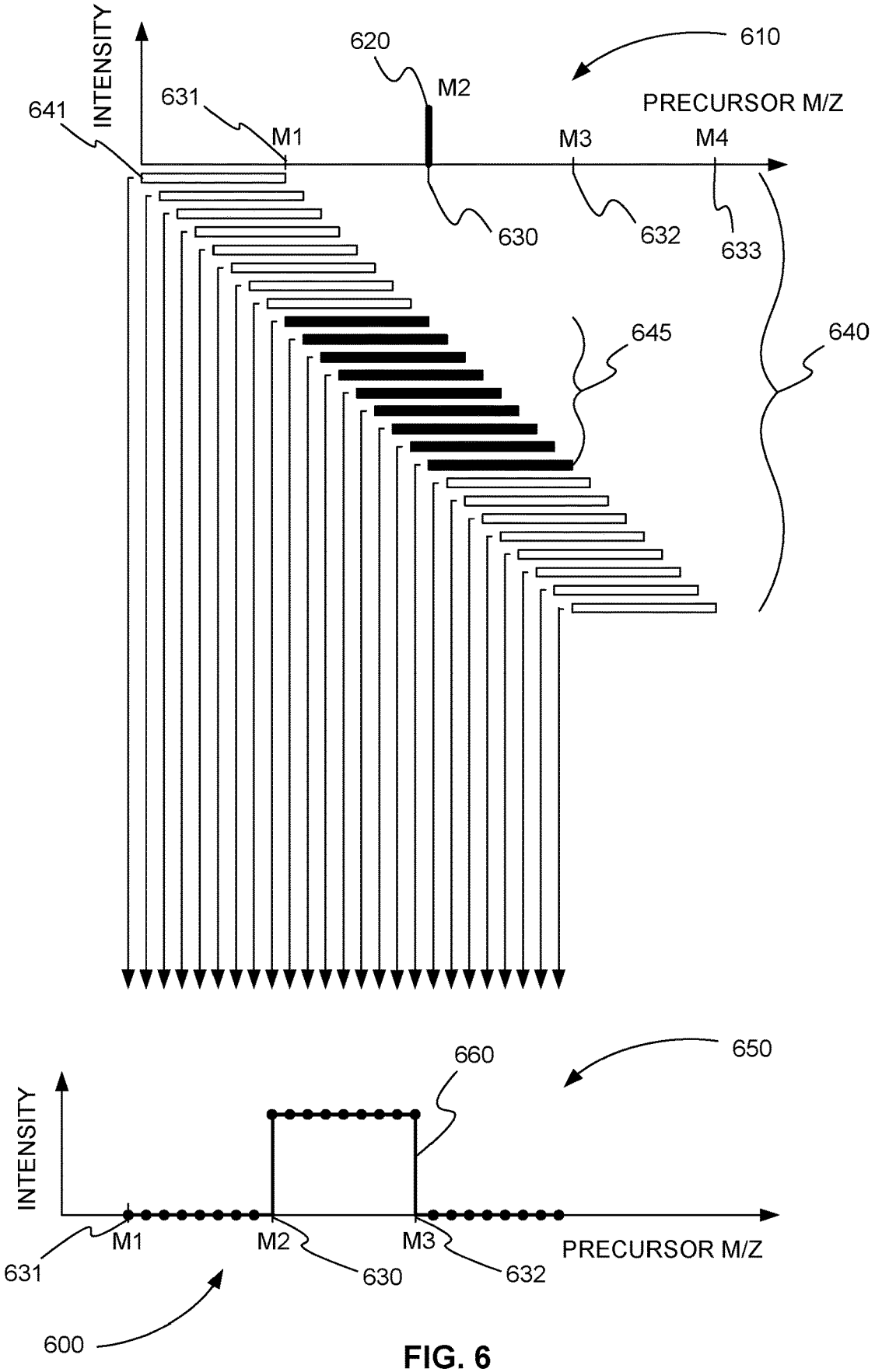
FIG. 6 is a diagram showing how a product ion produced from a precursor ion that is filtered by overlapping precursor ion mass selection windows in a scanning SWATH acquisition can be plotted as a function of the precursor ion mass selection window moving across the precursor mass range.
Figure 7:
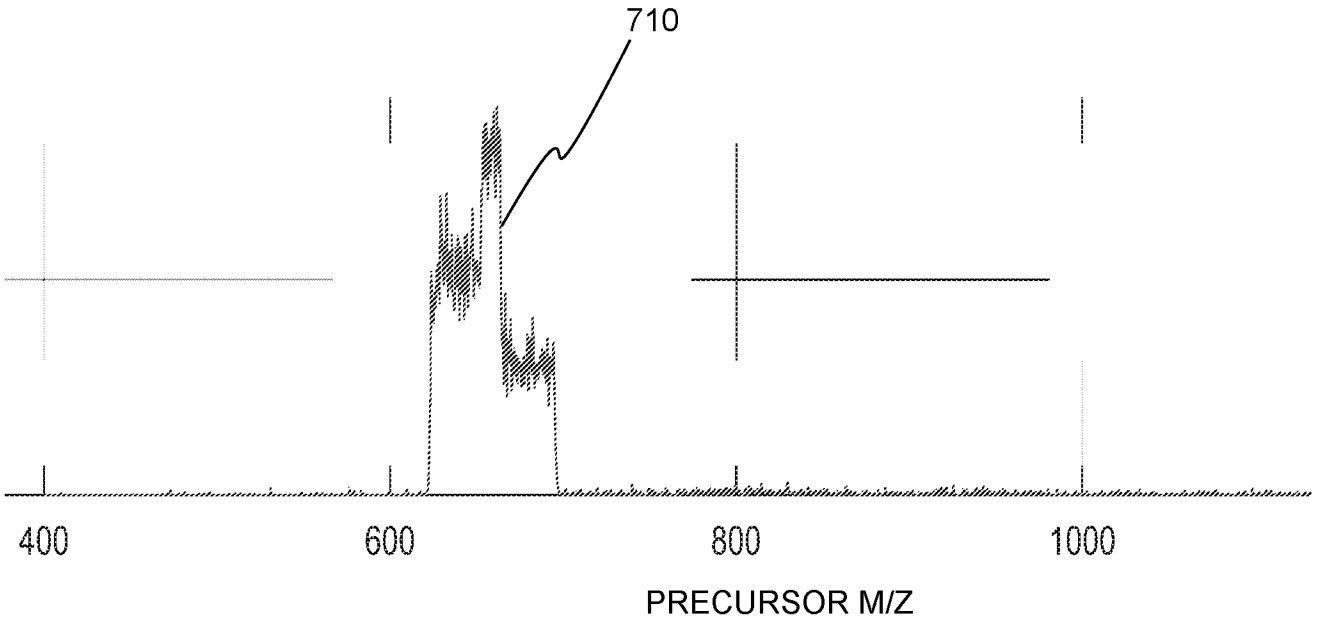
FIG. 7 is a plot of an exemplary quadrupole ion trace (QIT) calculated for a selected product ion that is produced from two interfering precursor ions using data from an actual scanning SWATH experiment.
Figure 8:
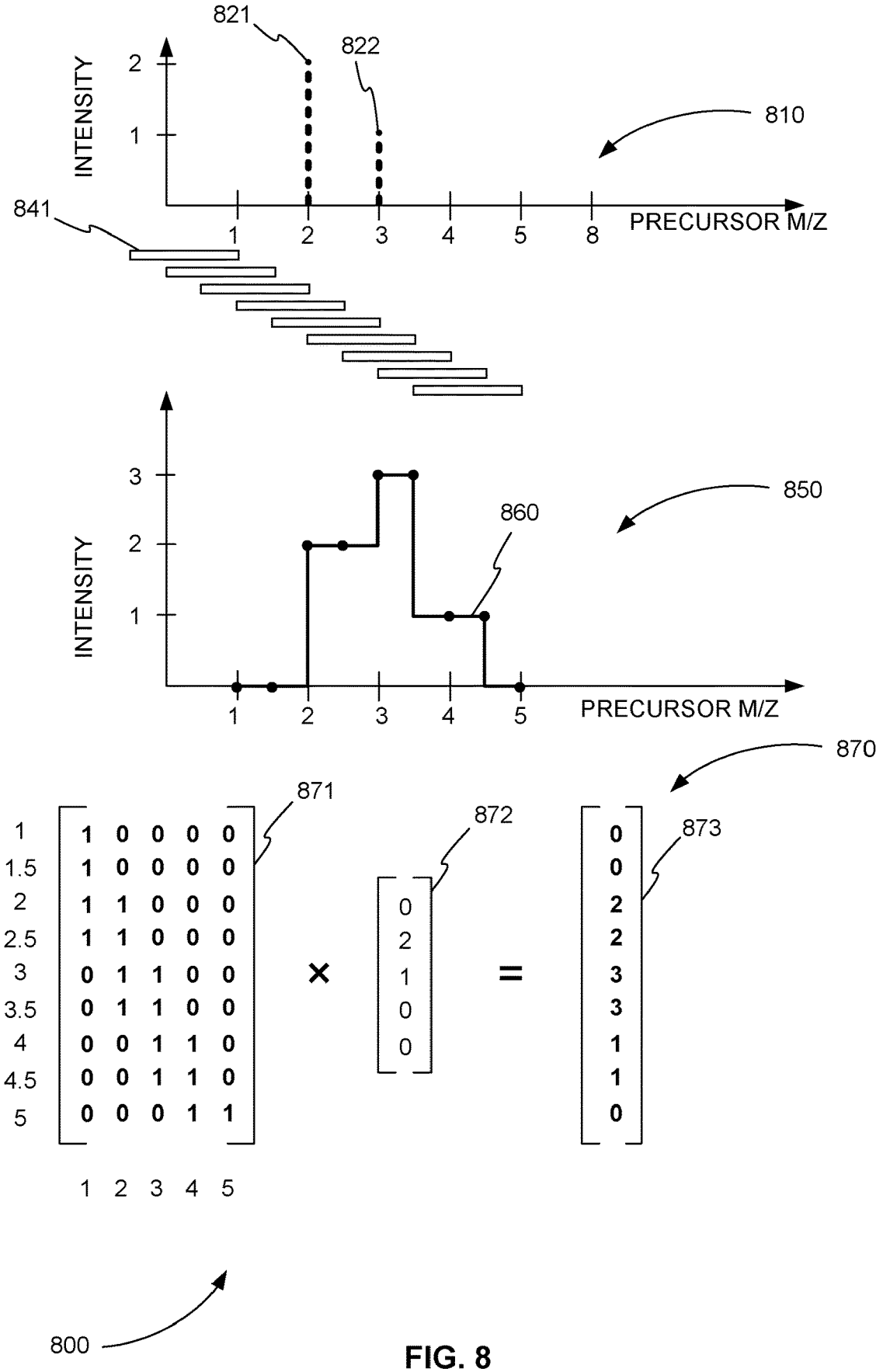
FIG. 8 is a diagram showing a simplified example of how corresponding precursor ions are determined from a product ion QIT using a system of linear equations represented by a matrix multiplication equation.
Figure 9:
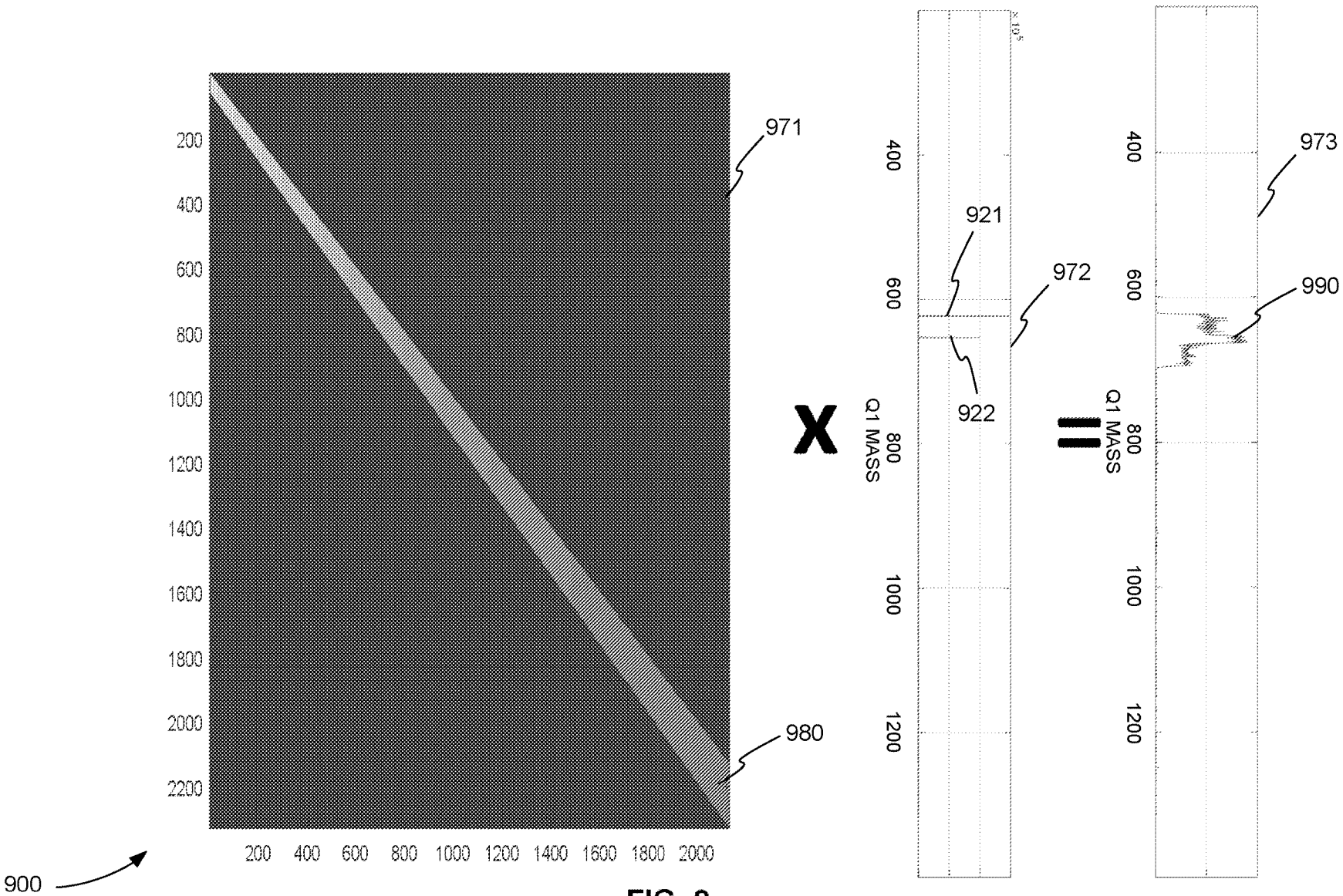
FIG. 9 is an exemplary matrix multiplication equation showing an experimental example of how corresponding precursor ions are determined from a product ion QIT.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively, hard-wired circuitry may be used in place of or in combination with software instructions to implement the present teachings. Thus implementations of the present teachings are not limited to any specific combination of hardware circuitry and software.

The term "computer-readable medium" as used herein refers to any media that participates in providing instructions to processor 104 for execution. Such a medium may take many forms, including but not limited to, non-volatile media, volatile media, and precursor ion mass selection media. Non-volatile media includes, for example, optical or magnetic disks, such as storage device 110. Volatile media includes dynamic memory, such as memory 106. Precursor ion mass selection media includes coaxial cables, copper wire, and fiber optics, including the wires that comprise bus 102.

Common forms of computer-readable media include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Scanning Sequential Windowed Precursor Ion Selection and Mass Analysis

As described above, a precursor ion survey scan is used, for example, in information dependent analysis (IDA) to determine the precursor ions that are to be fragmented. There is no knowledge of the origin of the precursor ions prior to their selection. Unfortunately, a precursor ion survey scan can include contaminants in addition to the precursor ions that originated from the ion source. These contaminants can include fragments or product ions of the precursor ions that are produced by some form of unintentional spontaneous fragmentation within the mass spectrometer. These contaminants can also include adducts that are produced when precursor ions pick up unexpected additional molecular material from within the mass spectrometer.

Figure 10:
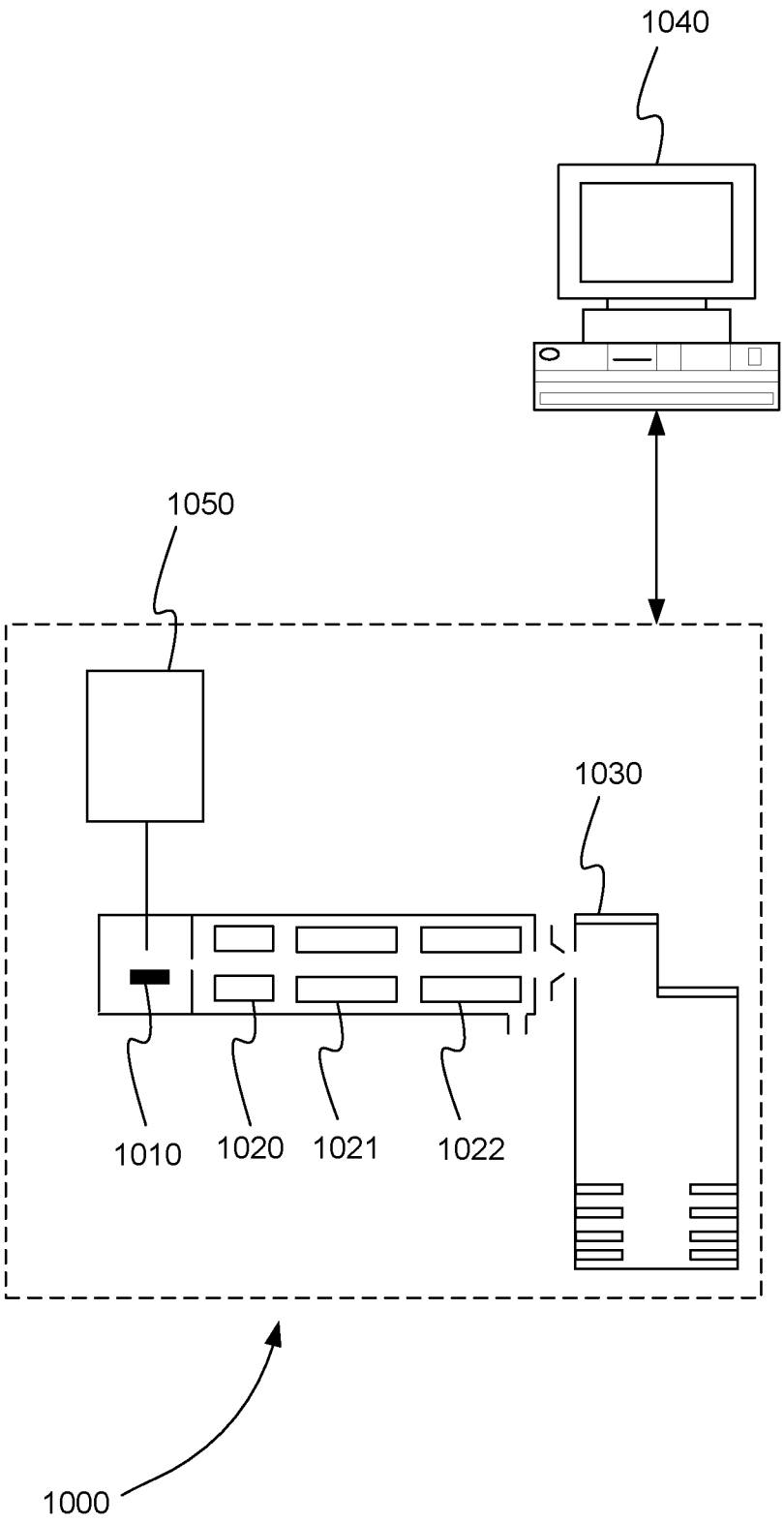
FIG. 10 is a schematic diagram showing a mass spectrometry system, in accordance with various embodiments.

FIG. 10 is a schematic diagram showing a mass spectrometry system 1000, in accordance with various embodiments. System 1000 includes ion source device 1010, mass filter 1021, fragmentation device 1022, mass analyzer 1030, and processor 1040. System 1000 further optionally includes sample introduction device 1050 and ion focusing device 1020. One skilled in the art will understand that in a quadrupole based system ion focusing device 1020, mass filter 1021, and fragmentation device 1022 can be referred to as $Q_0$, $Q_1$, and $Q_2$, respectively.

Ideally in a precursor ion survey scan, precursor ions produced by ion source device 1010 are focused by ion focusing device 1020, selected or filtered by mass filter 1021, transported without fragmentation by fragmentation device 1022 from mass filter 1021 to mass analyzer 1030, and mass analyzed by mass analyzer 1030. As described above, however, precursor ions can fragment or pick up additional molecular material anywhere along the ion path between mass filter 1021 and mass analyzer 1030.

Figure 11:
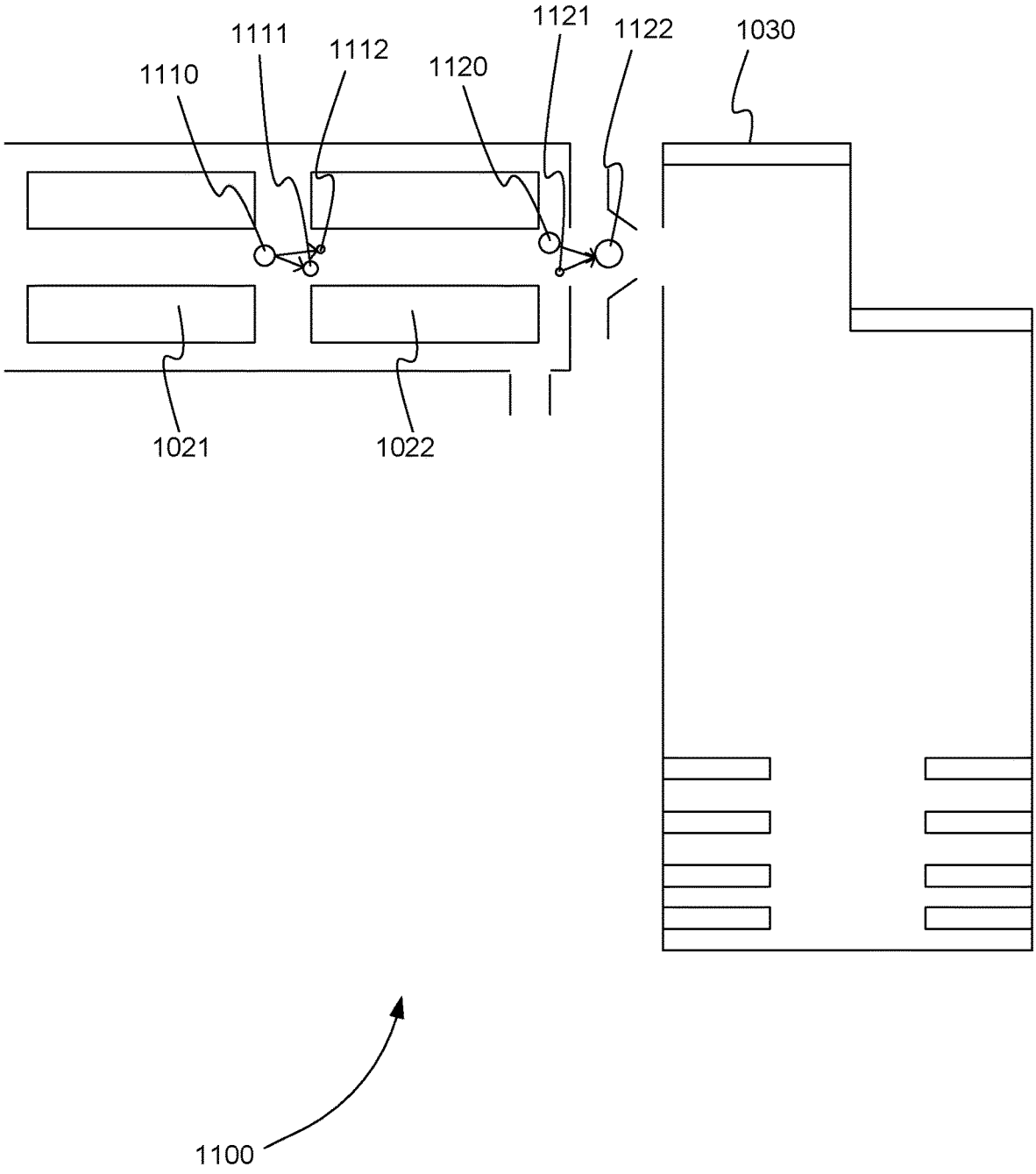
FIG. 11 is a close-up view of the ion path between the mass filter and the mass analyzer of FIG. 10, in accordance with various embodiments.

FIG. 11 is a close-up view 1100 of the ion path between the mass filter and the mass analyzer of FIG. 10, in accordance with various embodiments. This figure shows how product and adduct ions can be unintentionally produced along the ion path. It shows precursor ion 1110 unintentionally fragmenting into product ions 1111 and 1112 between mass filter 1021 and fragmentation device 1022. It also shows precursor ion 1120 unintentionally acquiring additional molecular material 1121 and becoming adduct ion 1122 between fragmentation device 1022 and mass analyzer 1030.

A precursor ion survey scan is often referred to as a low energy scan. This means that fragmentation device 1022 is given enough collision energy (CE) to move the selected precursor ions through it, but not enough CE to cause intentional fragmentation of the selected precursor ions. The selected precursor ions are moved through fragmentation device 1022 so they can be sent to mass analyzer 1030. Mass analyzer 1030 measures the m/z mass-to-charge ratio (m/z) of the selected precursor ions and produces a precursor ion spectrum. Even though the CE of fragmentation device 1022 is deliberately set low, precursor ions may still unintentionally fragment.

Figure 12:
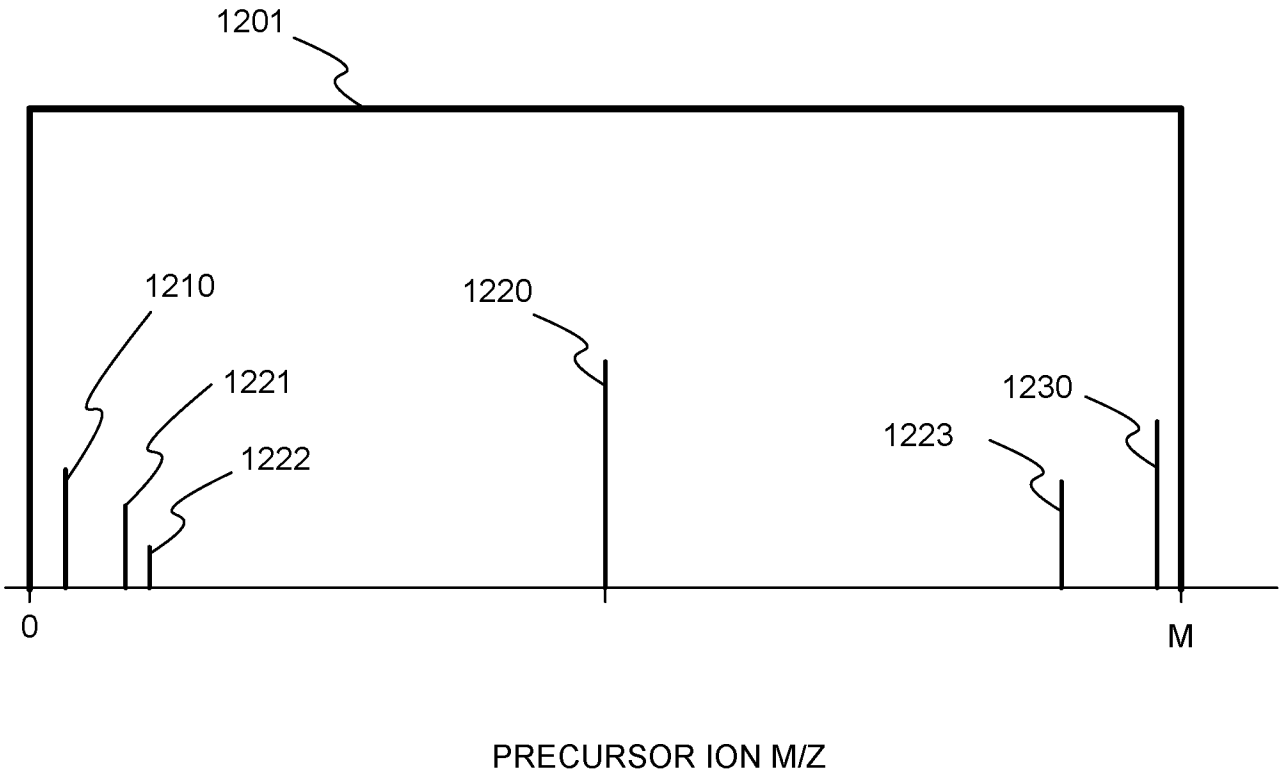
FIG. 12 is an exemplary precursor ion spectrum produced from a conventional precursor ion survey scan that shows how fragment ions and adducts can confound an IDA experiment, in accordance with various embodiments.

FIG. 12 is an exemplary precursor ion spectrum 1200 produced from a conventional precursor ion survey scan that shows how fragment ions and adducts can confound an IDA experiment, in accordance with various embodiments. Precursor ion spectrum 1200 is produced by mass filtering a precursor ion mass range between 0 m/z and M m/z. One skilled in the art understands that mass filtering can also be referred to as scanning, selecting, or isolating, for example.

In other words, the mass spectrometer selects precursor ions between 0 m/z and M m/z from an ion beam. The precursor ions are selected using a quadrupole, for example. The selection of the precursor ion mass range between 0 m/z and M m/z is performed in one step, time period, or cycle. This selection in one step, time period, or cycle can also be referred to as one precursor ion mass selection window 1201.

Precursor ion spectrum 1200 includes actual precursor ions 1210, 1220, and 1230, which originated from the ion source. Precursor ion spectrum 1200 also, however, includes contaminant ions 1221, 1222, and 1223. Ions 1221 and 1222 are product ions of precursor ion 1220. Product ions 1221 and 1222 are produced unintentionally somewhere along the ion path when precursor ion 1220 spontaneously fragmented or fragmented due to some unintentional collision, for example. Ion 1223 is an adduct of precursor ion 1220. Adduct ion 1223 includes precursor ion 1220 and some additional molecular material unintentionally obtained somewhere along the ion path when precursor ion 1220 was selected and moved to the mass analyzer.

In an IDA experiment, there is no prior knowledge about the precursor ions in the precursor ion mass range between 0 m/z and M m/z. As a result, it is not known that ions 1221, 1222, and 1223 are not precursor ions produced by the ion source device. Consequently, ions 1221, 1222, and 1223 may be fragmented and their resulting product ion spectra may be used in the analysis of a sample, potentially adversely affecting the results for the sample.

Mechanical filtering of contaminant ions, such as ions 1221, 1222, and 1223, is not currently possible with conventional methods for analyzing full scan IDA data. Conventional mass spectrometers allow the transmission of all ions whose mass or m/z is between the instrument settings, and detection of the ions is made. Therefore, a conventional precursor ion survey scan is convolved with the presence of not only the complex mixture of actual precursor ions but also the product ions of labile precursor ions, which are being transmitted.

In various embodiments, in order to remove contaminant ions, a wide band mass filter is used to allow a specific range of ions through the mass spectrometer. The wide band mass filter is applied using a Q1 quadrupole, for example. The wide band filter is ramped across the full precursor ion mass range and the transmitted precursor ions are mass analyzed.

Summation of the precursor ion data produces a combined scan that is equivalent to the conventional precursor ion survey scan. However, the data is only summed within the mass range for the location of the scanning quadrupole. Precursor ions that are not within this range are assumed to be product ions from the precursor ions within the range.

In other words, various embodiments include performing scanning sequential windowed precursor ion selection and mass analysis in order to determine the precursor ions actually produced by the ion source. This scanning sequential windowed precursor ion selection and mass analysis is similar to scanning SWATH, which is described above. This method of controlling the mass spectrometer, however, differs from scanning SWATH in that the scanned sequential precursor ion mass selection windows are not fragmented. Instead, the ions in each precursor ion mass selection window are simply mass analyzed.

In various embodiments, due to the filtering of the ions that are being transmitted to the detection system, it is possible to operate the mass spectrometer instrument without any ion focusing. For example, in a quadrupole-based mass spectrometer, quadrupole $Q_0$ is used to focus ions, quadrupole $Q_1$ is used to mass filter ions, and quadrupole $Q_2$ is used to fragment ions. Therefore, due to the filtering of the ions, it is possible to operate the mass spectrometer without any ion control in $Q_0$. This has the secondary effect of allowing all of the precursor ions from the ion source to be visible to the mass spectrometer, which can increase the limit of detection (LOD) of the mass spectrometer.

In various embodiments, it is also possible to apply a CE value to the scanning precursor ion survey scan. In this case, the precursor ions obtain a specific induced CE pattern. In such a case, product ions of the precursor ions are intentionally produced. This pseudo precursor ion scan allows for two types of analysis. By setting the ion detection range from the precursor ion scan to be lower than the precursor ion range by (x), a neutral loss based scan can be created. Although this scan does not have the complete specificity of the standard neutral loss with the deconvolution of the precursor and product ions and subsequent product ion spectrum, the precursor ion can be determined as well as a specific fragmentation pattern of the neutral loss components. By taking masses that are greater in mass than the parent isolation window, the identification of multiply charged species can be simplified.

System for Identifying Precursor Ions Originating from an Ion Source Device

Returning to FIG. 10, FIG. 10 also shows system 1000 for identifying precursor ions originating from an ion source device, in accordance with various embodiments. System 1000 of FIG. 10 includes ion source device 1010, mass filter 1021, fragmentation device 1022, mass analyzer 1030, and processor 1040. System 1000 can also include focusing device 1020, which can be, for example, a $Q_0$ quadrupole.

In various embodiments, system 1000 can further include sample introduction device 1050. Sample introduction device 1050 introduces one or more compounds of interest from a sample to ion source device 1010 over time, for example. Sample introduction device 1050 can perform techniques that include, but are not limited to, injection, liquid chromatography, gas chromatography, capillary electrophoresis, or ion mobility.

In system 1000, mass filter 1021 and fragmentation device 1022 are shown as different stages of a triple quadrupole and mass analyzer 1030 is shown as a time-of-flight (TOF) device. One of ordinary skill in the art can appreciate that any of these stages can include other types of mass spectrometry devices including, but not limited to, ion traps, orbitraps, ion mobility devices, or Fourier transform ion cyclotron resonance (FT-ICR) devices.

Ion source device 1010 transforms a sample or compounds of interest from a sample provided by sample introduction device 1050 into an ion beam. Ion source device 1010 can perform ionization techniques that include, but are not limited to, matrix assisted laser desorption/ionization (MALDI) or electrospray ionization (ESI).

Mass filter 1021 receives the ion beam from ion source device 1010. Processor 1040 instructs mass filter 1021 to filter the ion beam by scanning a precursor ion mass selection window with a width smaller than a precursor ion mass range of interest across a precursor ion mass range of interest in overlapping steps. This scanning of the precursor ion mass selection window produces a series of overlapping precursor ion mass selection windows across the precursor ion mass range. Processor 1040 also instructs mass filter 1021 to transmit precursor ions from each precursor ion mass selection window of the series of overlapping precursor ion mass selection windows to mass analyzer 1030.

Processor 1040, for example, instructs mass filter 1021 to scan the precursor ion mass selection window across a precursor ion mass range of interest so that the area of overlap between adjacent overlapping precursor ion mass selection windows is greater than the area of non-overlap between adjacent overlapping precursor ion mass selection windows. Ideally, the area of non-overlap is small enough to resolve a single precursor ion.

Figure 13:
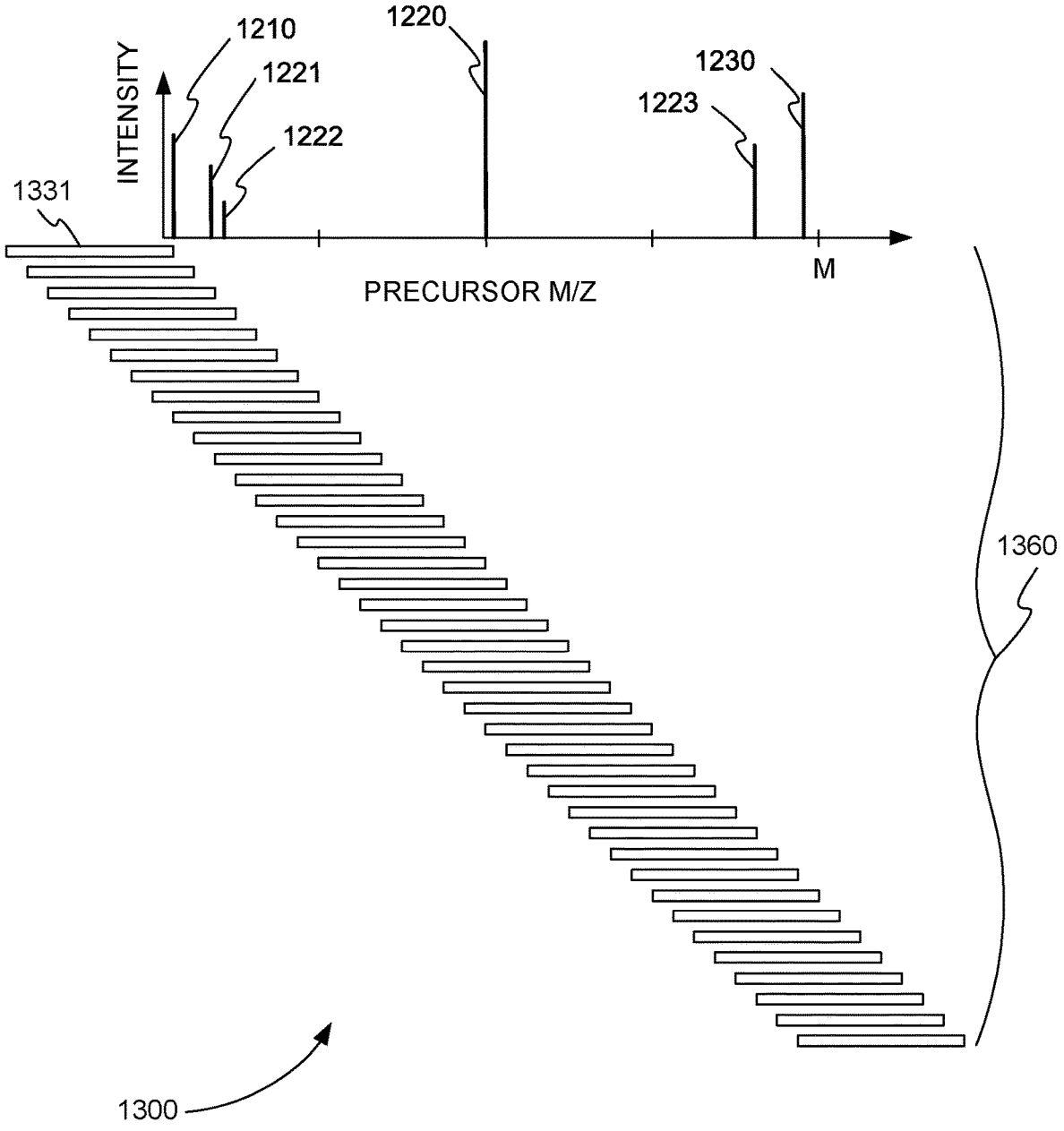
FIG. 13 is a diagram showing how the mass filter of FIG. 10 scans a precursor ion mass selection window with a width smaller than a precursor ion mass range of interest across a precursor ion mass range of interest in overlapping steps, in accordance with various embodiments.

FIG. 13 is a diagram 1300 showing how mass filter 1021 of FIG. 10 scans a precursor ion mass selection window with a width smaller than a precursor ion mass range of interest across a precursor ion mass range of interest in overlapping steps, in accordance with various embodiments. The mass range of interest, M, is the same mass range of interest shown in FIG. 12. For example, precursor ion mass selection window 1331 is scanned across a precursor ion mass range of interest, M, in overlapping steps. This scanning of precursor ion mass selection window 1331 produces series of overlapping precursor ion mass selection windows 1360 across the precursor ion mass range.

Returning to FIG. 10, processor 1040 can be, but is not limited to, a computer, a microprocessor, the computer system of FIG. 1, or any device capable of sending and receiving control signals and data from a tandem mass spectrometer and processing data. Processor 1040 is in communication with ion source device 1010, mass filter 1021, fragmentation device 1022, and mass analyzer 1030.

Mass analyzer 1030 receives the precursor ions from each precursor ion mass selection window of the series of overlapping precursor ion mass selection windows selected by mass filter 1021. Processor 1040 instructs mass analyzer 1030 to analyze the precursor ions of each precursor ion mass selection window of the series of overlapping precursor ion mass selection windows. A precursor ion spectrum is produced for each overlapping precursor ion mass selection window and a plurality of precursor ion spectra are produced for the precursor ion mass range.

Figure 14:
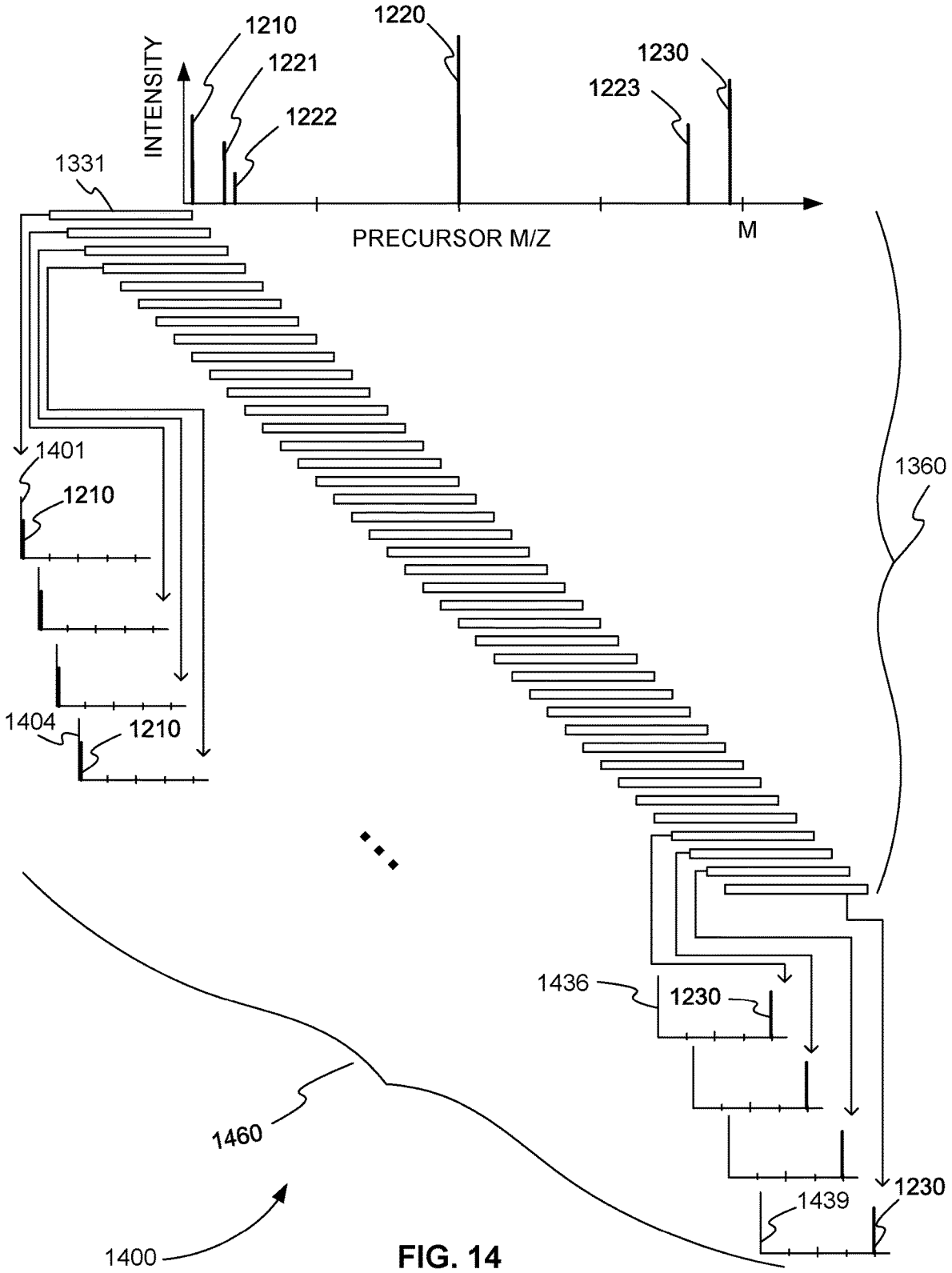
FIG. 14 is a diagram showing how the mass analyzer of FIG. 10 produces a precursor ion spectrum for each overlapping precursor ion mass selection window, in accordance with various embodiments.

FIG. 14 is a diagram 1400 showing how mass analyzer 1030 of FIG. 10 produces a precursor ion spectrum for each overlapping precursor ion mass selection window, in accordance with various embodiments. The mass range of interest, M, is again the same mass range of interest shown in FIG. 12. For example, when mass analyzer 1030 analyzes the first step of precursor ion mass selection window 1331, it produces precursor ion spectrum 1401. The precursor ions of each precursor ion mass selection window of series of overlapping precursor ion mass selection windows 1360 is mass analyzed. This produces plurality of precursor ion spectra 1460.

Note that precursor ion spectrum 1404 only includes precursor ion 1210 even though the width of this fourth step of precursor ion mass selection window 1331 appears to include ions 1221 and 1222. Recall, however, that ions 1221 and 1222 are product ions of precursor ion 1220. Since the fourth step of precursor ion mass selection window 1331 does not include precursor ion 1220, it cannot include product ions 1221 and 1222 of precursor ion 1220. In other words, the scanning of precursor ion mass selection window 1331 has not yet reached precursor ion 1220.

Similarly, precursor ion spectrum 1436 only includes precursor ion 1230 even though the width of the $36^{th}$ step of precursor ion mass selection window 1331 appears to include ion 1223. Recall, however, that ion 1223 is an adduct ion of precursor ion 1220. Since the $36^{th}$ step of precursor ion mass selection window 1331 does not include precursor ion 1220, it cannot include adduct ion 1223 of precursor ion 1220. In other words, the scanning of precursor ion mass selection window 1331 has passed precursor ion 1220 and it is no longer being selected.

Returning to FIG. 10, processor 1040 receives the plurality of precursor ion spectra from mass analyzer 1030 and performs the following steps. (A) processor 1040 selects a precursor ion from the plurality of precursor ion spectra that has an intensity above a predetermined threshold. (B) For the selected precursor ion, processor 1040 retrieves the intensities of the selected precursor ion from the plurality of precursor ion spectra for at least one scan of the precursor ion mass selection window across the precursor ion mass range. Further, processor 1040 produces a trace that describes how the intensity of the selected precursor ion varies with the location of the precursor ion mass selection window expressed as the precursor ion m/z of the precursor ion mass selection window as the precursor ion mass selection window is scanned across the precursor ion mass range. (C) processor 1040 identifies the selected precursor ion as a precursor ion originating from the ion source device if the trace includes a nonzero intensity for the m/z value of the selected precursor ion.

Figure 15:
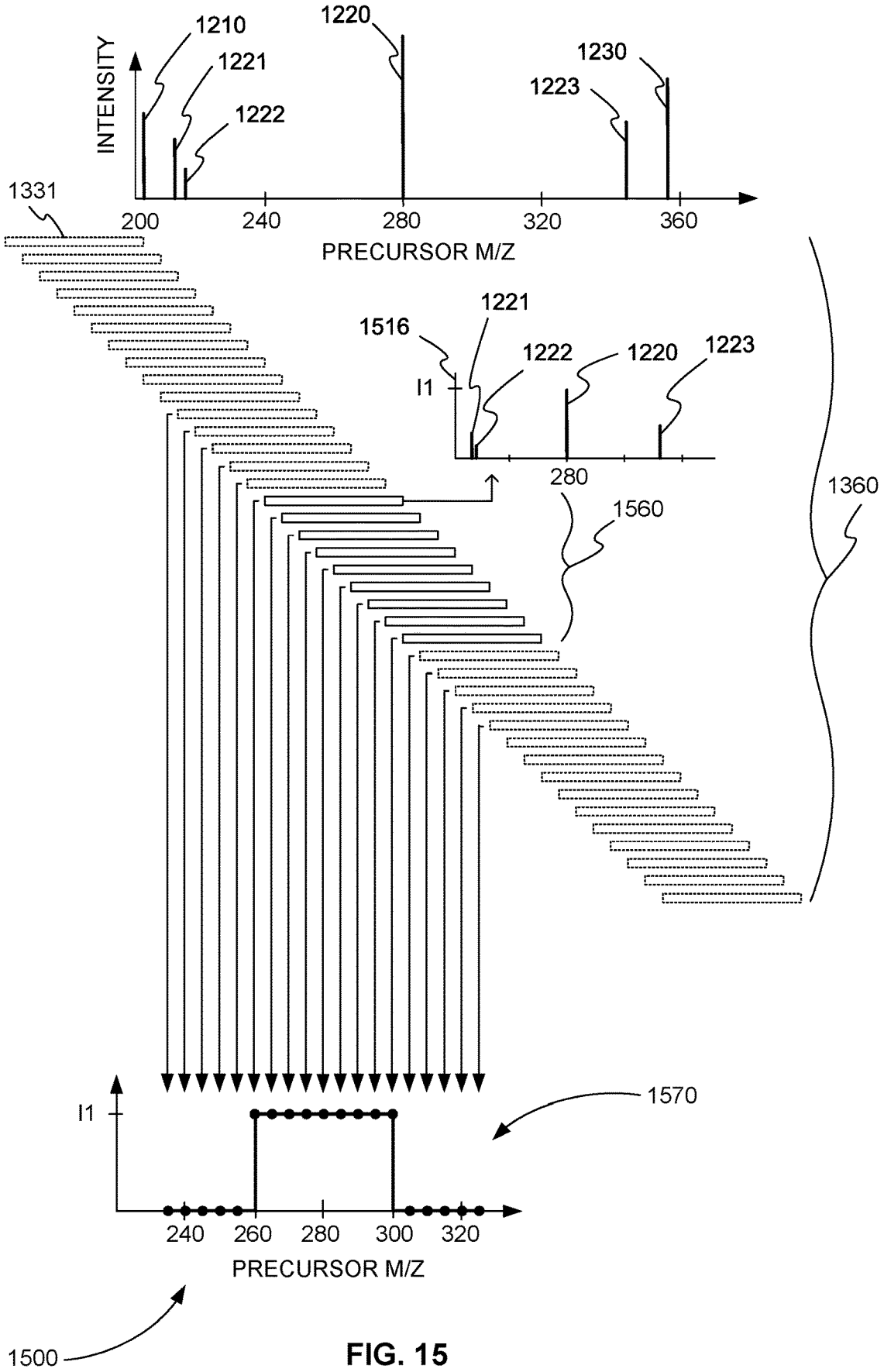
FIG. 15 is a diagram showing how a precursor ion is identified as a precursor ion originating from the ion source device, in accordance with various embodiments.

FIG. 15 is a diagram 1500 showing how a precursor ion is identified as a precursor ion originating from the ion source device, in accordance with various embodiments. In step (A) precursor ion 1220 is selected from precursor ion spectrum 1516 of a plurality of precursor ion spectra produced for series of overlapping precursor ion mass selection windows 1360 across the precursor ion mass range from 200 m/z to 360 m/z. Precursor ion 1220 is above a predetermined threshold.

The series of overlapping precursor ion mass selection windows 1360 is produced by scanning precursor ion mass selection window 1331 across the 160 m/z mass range in 5 m/z steps. The width of precursor ion mass selection window 1331 is 20 m/z, for example. The location of precursor ion mass selection window 1331 across the 160 m/z precursor ion mass range is expressed in terms of the center of precursor ion mass selection window 1331. In various embodiments, the location of precursor ion mass selection window 1331 can be expressed in terms of any part of precursor ion mass selection 1331 including, but not limited to, its beginning, its center, or its end.

In step (B), for the selected precursor ion 1220, the intensities of selected precursor ion 1220 are retrieved from the plurality of precursor ion spectra for at least one scan of the precursor ion mass selection window across the 160 m/z precursor ion mass range. Since only overlapping precursor ion mass selection windows 1560 will isolate selected precursor ion 1220, only the precursor ion spectra from these precursor ion mass selection windows will have nonzero intensities for selected precursor ion 1220. For example, in precursor ion spectrum 1516 selected precursor ion 1220 has a nonzero intensity, I1. Precursor ion spectrum 1516 is produced by the $16^{th}$ step of precursor ion mass selection window 1331. The precursor ion spectra produced by the other windows of overlapping precursor ion mass selection windows 1560 will be essentially the same as precursor ion spectrum 1516. Note that precursor ion spectrum 1516 also includes product ions 1221 and 1222 of precursor ion 1220 and adduct ion 1223 of precursor ion 1220.

A trace is then produced that describes how the intensity of selected precursor ion 1220 varies with the location of precursor ion mass selection window 1331 expressed as the precursor ion m/z of precursor ion mass selection window 1331 as the precursor ion mass selection window is scanned across the precursor ion mass range. As described above, the center of precursor ion mass selection window 1331 is used to specify its location. Plot 1570 shows a portion of the trace for selected precursor ion 1220. This is the only portion of the trace with nonzero intensities. Note that the trace has nonzero intensities when the center of precursor ion mass selection window 1331 is between 260 m/z to 300 m/z.

In step (C), selected precursor ion 1220 is identified as a precursor ion originating from the ion source device if the trace includes a nonzero intensity for the m/z value of the selected precursor ion. Plot 1570 shows that the trace for selected precursor ion 1220 includes nonzero intensity values between 260 m/z and 300 m/z. Selected precursor ion 1220 has an m/z value of 280. Because the trace for selected precursor ion 1220 includes a nonzero intensity for the m/z value of selected precursor 1220, selected precursor ion 1220 is identified as a precursor ion originating from the ion source device.

Figure 16:
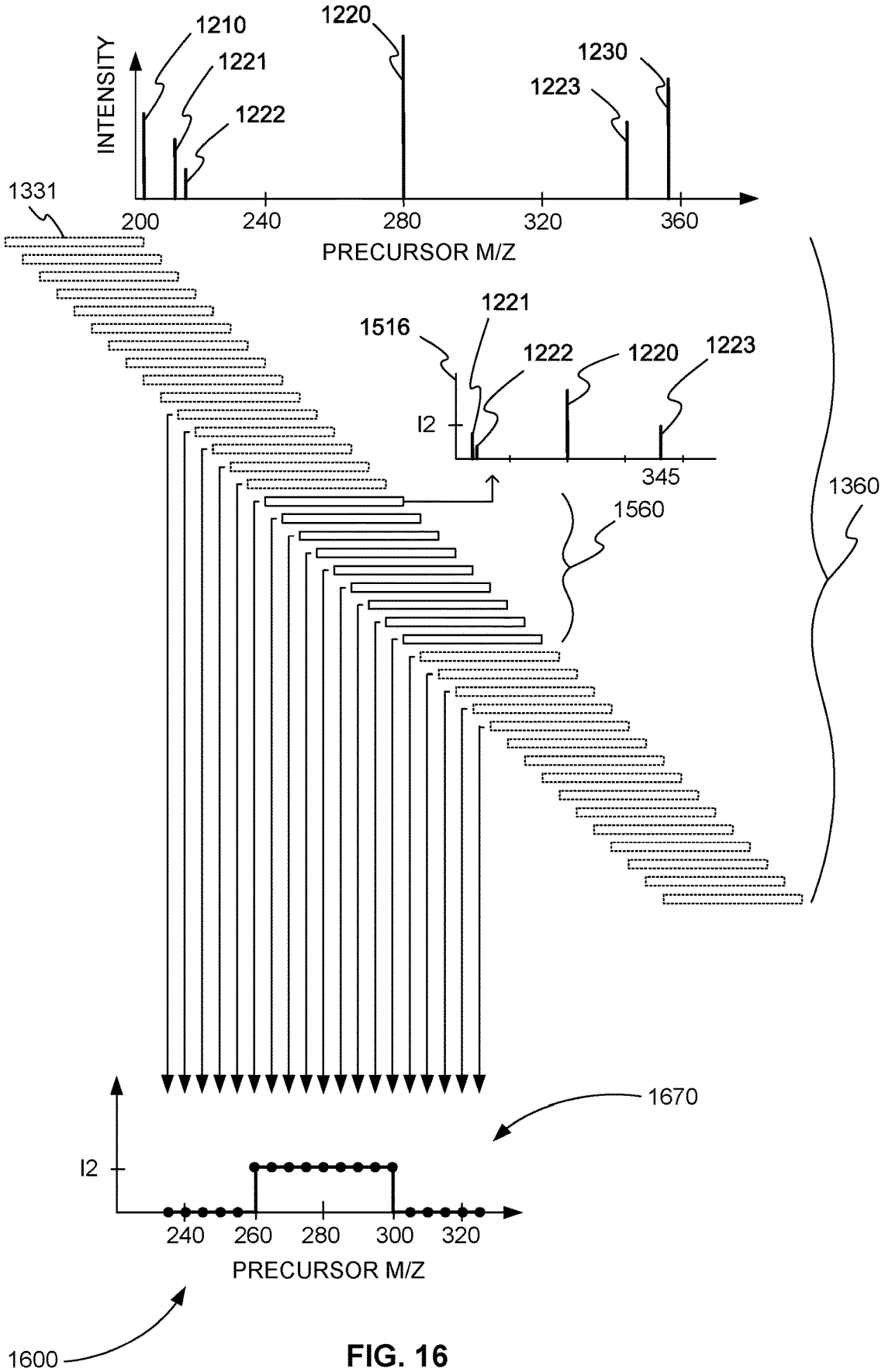
FIG. 16 is a diagram showing how a precursor ion is identified as an ion not originating from the ion source device, in accordance with various embodiments.

FIG. 16 is a diagram 1600 showing how a precursor ion is identified as an ion not originating from the ion source device, in accordance with various embodiments. In step (A) precursor ion 1223 is selected from precursor ion spectrum 1516 of a plurality of precursor ion spectra produced for series of overlapping precursor ion mass selection windows 1360 across the precursor ion mass range from 200 m/z to 360 m/z. Precursor ion 1223 is above a predetermined threshold. Recall that precursor ion 1223 is an adduct ion of precursor ion 1220.

In step (B), for the selected precursor ion 1223, the intensities of selected precursor ion 1223 are retrieved from the plurality of precursor ion spectra for at least one scan of the precursor ion mass selection window across the 160 m/z precursor ion mass range. Since only overlapping precursor ion mass selection windows 1560 will isolate selected precursor ion 1223, only the precursor ion spectra from these precursor ion mass selection windows will have nonzero intensities for selected precursor ion 1223. Only overlapping precursor ion mass selection windows 1560 will isolate selected precursor ion 1223, because precursor ion 1223 is an adduct of precursor ion 1220 and only overlapping precursor ion mass selection windows 1560 will isolate precursor ion 1220.

For example, in precursor ion spectrum 1516 selected precursor ion 1223 has a nonzero intensity, I2. Precursor ion spectrum 1516 is produced by the $16^{th}$ step of precursor ion mass selection window 1331. The precursor ion spectra produced by the other windows of overlapping precursor ion mass selection windows 1860 will be essentially the same as precursor ion spectrum 1516. Note that precursor ion spectrum 1516 also includes precursor ion 1220 and product ions 1221 and 1222 of precursor ion 1220.

A trace is then produced that describes how the intensity of selected precursor ion 1223 varies with the location of the precursor ion mass selection window expressed as the precursor ion m/z of the precursor ion mass selection window as the precursor ion mass selection window is scanned across the precursor ion mass range. Plot 1670 shows a portion of the trace for selected precursor ion 1223. This is the only portion of the trace with nonzero intensities.

In step (C), selected precursor ion 1223 is identified as a precursor ion originating from the ion source device if the trace includes a nonzero intensity for the m/z value of the selected precursor ion. Plot 1670 shows that the trace for selected precursor ion 1223 includes nonzero intensity values between 260 m/z and 300 m/z. Selected precursor ion 1223 has an m/z value of 345. Because the trace for selected precursor ion 1223 does not have a nonzero intensity for the m/z value of selected precursor 1223, selected precursor ion 1223 is not identified as a precursor ion originating from the ion source device. In other words, selected precursor ion 1223 is filtered out.

Therefore, returning to FIG. 10, processor 1040 can also identify a selected precursor ion as a precursor ion not originating from an ion source if the m/z value of the selected precursor ion is not within an m/z range of the trace. In other words, processor 1040 can filter out selected precursor ions if the m/z value of the selected precursor ion is not within an m/z range of the trace.

In various embodiments, processor 1040 repeats steps (A)-(C) for each precursor ion from the plurality of precursor ion spectra that has an intensity above the predetermined threshold in order to filter all precursor ions from the plurality of precursor ion spectra. In other words, processor 1040 repeats steps (A)-(C) for the remaining precursor ions in order to filter all precursor ions.

In various embodiments, fragmentation device 1022 is located along the ion path between mass filter 1021 and mass analyzer 1030. Fragmentation device 1022 can be, for example, a collision cell. Processor 1040 instructs fragmentation device 1022 to apply a CE that is high enough to transport precursor ions from each precursor ion mass selection window of the series of overlapping precursor ion mass selection windows from mass filter 1021 to mass analyzer 1030.

In various embodiments, processor 1040 performs the steps described above as a survey scan of an IDA experiment and determines a list of precursor ions to fragment from the precursor ions found to originate from ion source device 1010. As part of the IDA experiment processor 1040 can further instruct mass filter 1021 to select each precursor ion of the list of precursor ions, instruct fragmentation device 1022 to fragment each precursor ion on the list of precursor ions, and instruct mass analyzer 1030 to analyze the product ions of each precursor ion on the list of precursor ions.

In various embodiments, processor 1040 instructs mass filter 1021 to select the width of the precursor ion mass selection window that is scanned across the precursor ion mass range of interest to be small enough so that product ions and adducts of the precursor ions are outside of the precursor ion mass selection window as it is scanned. In addition, processor 1040 instructs mass filter 1021 to select the width of the precursor ion mass selection window to be large enough to be scanned across the mass range of interest within a time limit required for the IDA experiment.

Method for Identifying Precursor Ions Originating from an Ion Source Device

Figure 17:
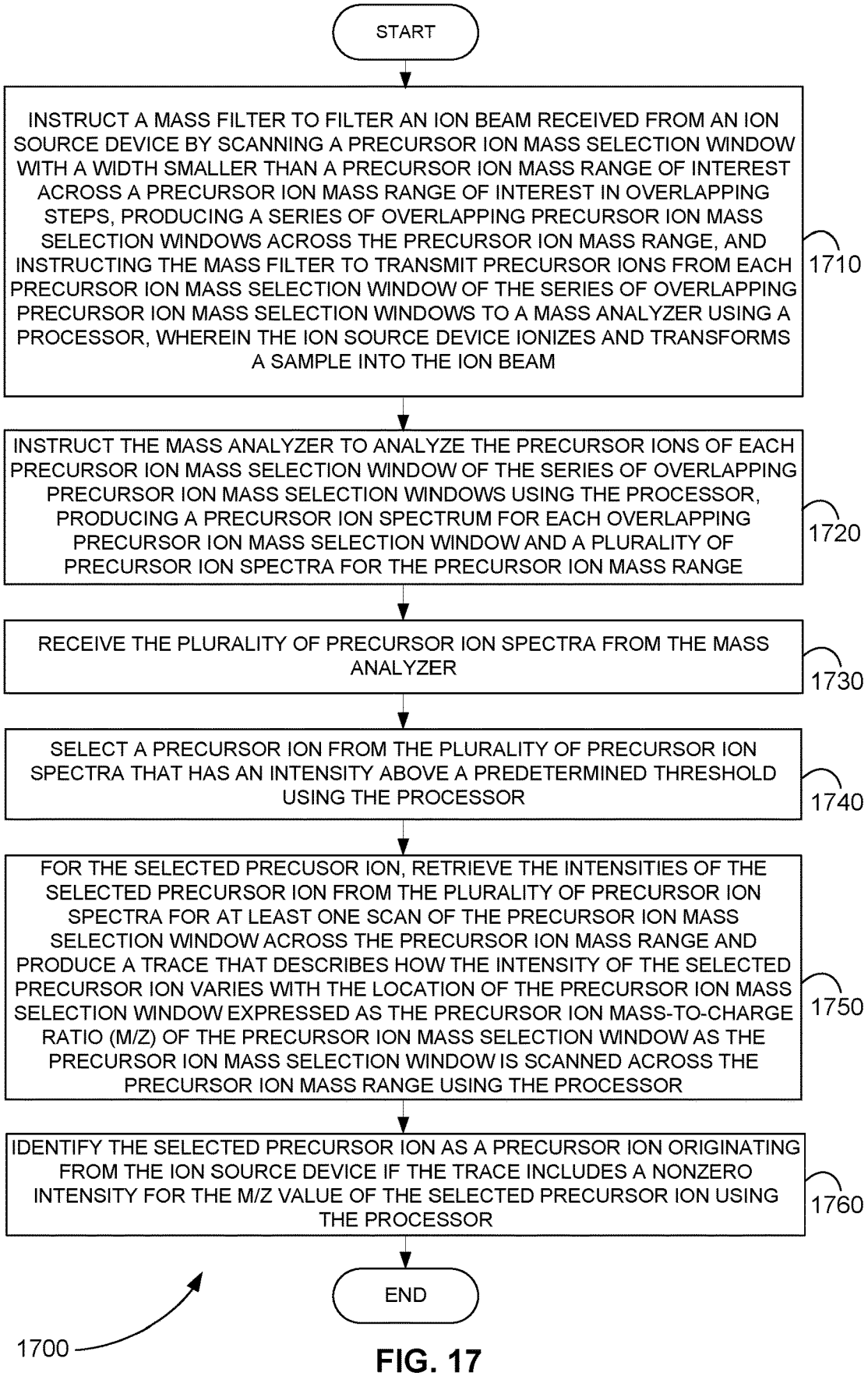
FIG. 17 is a flowchart showing a method for identifying precursor ions originating from an ion source device using a scanning sequential windowed precursor ion selection and mass analysis survey scan, in accordance with various embodiments.

FIG. 17 is a flowchart 1700 showing a method for identifying precursor ions originating from an ion source device using a scanning sequential windowed precursor ion selection and mass analysis survey scan, in accordance with various embodiments.

In step 1710 of method 1700, a mass filter is instructed to filter an ion beam received from an ion source device. It is instructed to filter the ion beam by scanning a precursor ion mass selection window with a width smaller than a precursor ion mass range of interest across a precursor ion mass range of interest in overlapping steps. This produces a series of overlapping precursor ion mass selection windows across the precursor ion mass range. The mass filter is also instructed to transmit precursor ions from each precursor ion mass selection window of the series of overlapping precursor ion mass selection windows to a mass analyzer. The ion source device ionizes and transforms a sample into the ion beam.

In step 1720, the mass analyzer is instructed to analyze the precursor ions of each precursor ion mass selection window of the series of overlapping precursor ion mass selection windows. This produces a precursor ion spectrum for each overlapping precursor ion mass selection window and a plurality of precursor ion spectra for the precursor ion mass range.

In step 1730, the plurality of precursor ion spectra are received from the mass analyzer.

In step 1740, a precursor ion is selected from the plurality of precursor ion spectra that has an intensity above a predetermined threshold.

In step 1750, for the selected precursor ion, the intensities of the selected precursor ion are retrieved from the plurality of precursor ion spectra for at least one scan of the precursor ion mass selection window across the precursor ion mass range. In addition, a trace is produced that describes how the intensity of the selected precursor ion varies with the location of the precursor ion mass selection window expressed as the precursor ion m/z of the precursor ion mass selection window as the precursor ion mass selection window is scanned across the precursor ion mass range.

In step 1760, the selected precursor ion is identified as a precursor ion originating from the ion source device if the trace includes a nonzero intensity for the m/z value of the selected precursor ion.

Computer Program Product for Identifying Precursor Ions Originating from an Ion Source Device In various embodiments, a computer program product includes a non-transitory tangible computer-readable storage medium whose contents include a program with instructions being executed on a processor so as to perform a method for identifying precursor ions originating from an ion source device using a scanning sequential windowed precursor ion selection and mass analysis survey scan. This method is performed by a system that includes one or more distinct software modules.

Figure 18:
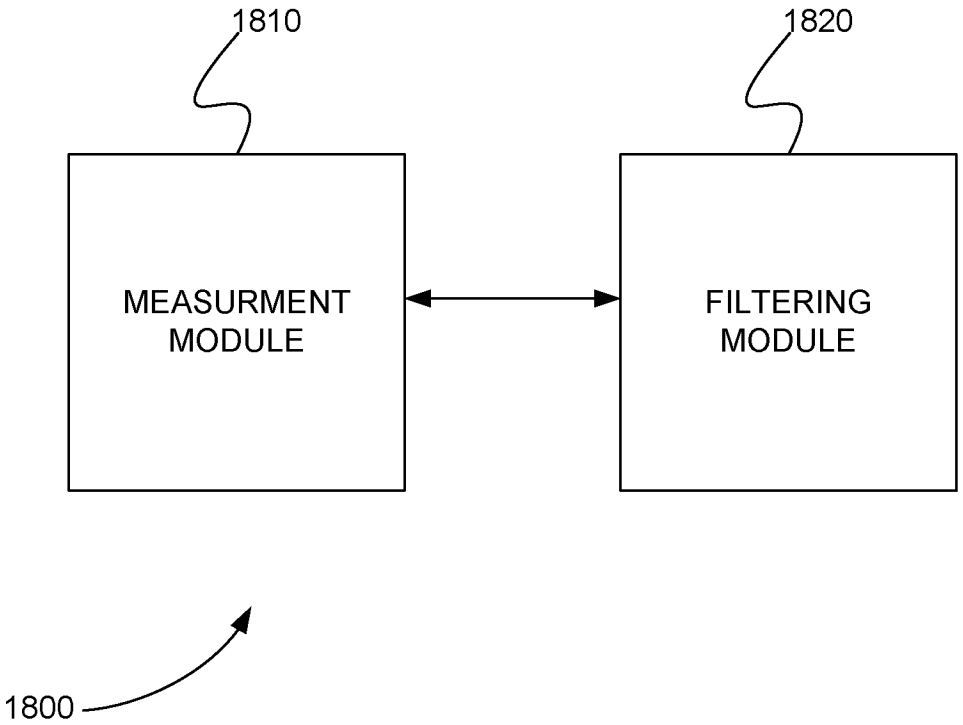
FIG. 18 is a schematic diagram of a system that includes one or more distinct software modules that performs a method for identifying precursor ions originating from an ion source device using a scanning sequential windowed precursor ion selection and mass analysis survey scan, in accordance with various embodiments.

FIG. 18 is a schematic diagram of a system 1800 that includes one or more distinct software modules that performs a method for identifying precursor ions originating from an ion source device using a scanning sequential windowed precursor ion selection and mass analysis survey scan, in accordance with various embodiments. System 1800 includes measurement module 1810 and filtering module 1820.

Measurement module 1810 instructs a mass filter to filter an ion beam received from an ion source device by scanning a precursor ion mass selection window with a width smaller than a precursor ion mass range of interest across a precursor ion mass range of interest in overlapping steps. This produces a series of overlapping precursor ion mass selection windows across the precursor ion mass range. In addition, measurement module 1810 instructs the mass filter to transmit precursor ions from each precursor ion mass selection window of the series of overlapping precursor ion mass selection windows to a mass analyzer. The ion source device ionizes and transforms a sample into the ion beam.

Measurement module 1810 instruct the mass analyzer to analyze the precursor ions of each precursor ion mass selection window of the series of overlapping precursor ion mass selection windows. This produces a precursor ion spectrum for each overlapping precursor ion mass selection window and a plurality of precursor ion spectra for the precursor ion mass range.

Filtering module 1820 receives the plurality of precursor ion spectra from the mass analyzer. Filtering module 1820 selects a precursor ion from the plurality of precursor ion spectra that has an intensity above a predetermined threshold. For the selected precursor ion, filtering module 1820 retrieves the intensities of the selected precursor ion from the plurality of precursor ion spectra for at least one scan of the precursor ion mass selection window across the precursor ion mass range. Filtering module 1820 then produces a trace that describes how the intensity of the selected precursor ion varies with the location of the precursor ion mass selection window expressed as the precursor ion m/z of the precursor ion mass selection window as the precursor ion mass selection window is scanned across the precursor ion mass range. Finally, filtering module 1820 identifies the selected precursor ion as a precursor ion originating from the ion source device if the trace includes a nonzero intensity for the m/z value of the selected precursor ion.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for identifying precursor ions originating from an ion source device using a scanning sequential windowed precursor ion selection and mass analysis survey scan, comprising:

an ion source device that ionizes and transforms a sample into an ion beam;

a mass filter receives the ion beam;

a mass analyzer; and a processor in communication with the mass filter and the mass analyzer that (a) instructs the mass filter to filter the ion beam by scanning a precursor ion mass selection window with a width smaller than a precursor ion mass range of interest across a precursor ion mass range of interest in overlapping steps, producing a series of overlapping precursor ion mass selection windows across the precursor ion mass range, and instructs the mass filter to transmit precursor ions from each precursor ion mass selection window of the series of overlapping precursor ion mass selection windows to the mass analyzer, (b) instructs the mass analyzer to analyze the precursor ions of each precursor ion mass selection window of the series of overlapping precursor ion mass selection windows, producing a precursor ion spectrum for each overlapping precursor ion mass selection window and a plurality of precursor ion spectra for the precursor ion mass range, (c) receives the plurality of precursor ion spectra from the mass analyzer, (d) selects a precursor ion from the plurality of precursor ion spectra that has an intensity above a predetermined threshold, (e) for the selected precursor ion, retrieves the intensities of the selected precursor ion from the plurality of precursor ion spectra for at least one scan of the precursor ion mass selection window across the precursor ion mass range and produces a trace that describes how the intensity of the selected precursor ion varies with the location of the precursor ion mass selection window expressed as the precursor ion mass-to-charge ratio (m/z) of the precursor ion mass selection window as the precursor ion mass selection window is scanned across the precursor ion mass range, and (f) identifies the selected precursor ion as a precursor ion originating from the ion source device if the trace includes a nonzero intensity for the m/z value of the selected precursor ion.

2. The system of claim 1, wherein the processor identifies the selected precursor ion as a precursor ion not originating from an ion source if the m/z value of the selected precursor ion is not within an m/z range of the trace.

3. The system of claim 1, wherein the processor repeats steps (d)-(f) for each precursor ion from the plurality of precursor ion spectra that has an intensity above the predetermined threshold in order to filter all precursor ions from the plurality of precursor ion spectra.

4. The system of claim 3, further comprising a fragmentation device located along an ion path between the mass filter and the mass analyzer.

5. The system of claim 4, wherein the processor performs steps (a)-(f) as a survey scan of an information dependent acquisition (IDA) experiment and determines a list of precursor ions to fragment from the precursor ions found to originate from the ion source device.

6. The system of claim 5, wherein the processor further instructs the mass filter to select each precursor ion of the list of precursor ions, instructs the fragmentation device to fragment each precursor ion of the list of precursor ions, and instructs the mass analyzer to analyze the product ions of each precursor ion of the list of precursor ions as part of the IDA experiment.

7. The system of claim 1, wherein the processor instructs the mass filter to scan the precursor ion mass selection window across a precursor ion mass range of interest so that the area of overlap between adjacent overlapping precursor ion mass selection windows is greater than the area of non-overlap between adjacent overlapping precursor ion mass selection windows.

8. The system of claim 5, wherein the processor instructs the mass filter to select the width of the precursor ion mass selection window that is scanned across the precursor ion mass range of interest to be small enough so that product ions and adducts of the precursor ions are outside of the precursor ion mass selection window as it is scanned and to be large enough to be scanned across the mass range of interest within a time limit required for the IDA experiment.

9. A method for identifying precursor ions originating from an ion source device using a scanning sequential windowed precursor ion selection and mass analysis survey scan, comprising:

(a) instructing a mass filter to filter an ion beam received from an ion source device by scanning a precursor ion mass selection window with a width smaller than a precursor ion mass range of interest across a precursor ion mass range of interest in overlapping steps, producing a series of overlapping precursor ion mass selection windows across the precursor ion mass range, and instructing the mass filter to transmit precursor ions from each precursor ion mass selection window of the series of overlapping precursor ion mass selection windows to a mass analyzer using a processor, wherein the ion source device ionizes and transforms a sample into the ion beam;

(b) instructing the mass analyzer to analyze the precursor ions of each precursor ion mass selection window of the series of overlapping precursor ion mass selection windows using the processor, producing a precursor ion spectrum for each overlapping precursor ion mass selection window and a plurality of precursor ion spectra for the precursor ion mass range;

(c) receiving the plurality of precursor ion spectra from the mass analyzer using the processor;

(d) selecting a precursor ion from the plurality of precursor ion spectra that has an intensity above a predetermined threshold using the processor;

(e) for the selected precursor ion, retrieving the intensities of the selected precursor ion from the plurality of precursor ion spectra for at least one scan of the precursor ion mass selection window across the precursor ion mass range and produces a trace that describes how the intensity of the selected precursor ion varies with the location of the precursor ion mass selection window expressed as the precursor ion mass-to-charge ratio (m/z) of the precursor ion mass selection window as the precursor ion mass selection window is scanned across the precursor ion mass range using the processor; and (f) identifying the selected precursor ion as a precursor ion originating from the ion source device if the trace includes a nonzero intensity for the m/z value of the selected precursor ion using the processor.

10. The method of claim 9, further comprising identifying the selected precursor ion as a precursor ion not originating from an ion source if the m/z value of the selected precursor ion is not within an m/z range of the trace using the processor.

11. The method of claim 9, further comprising repeating steps (d)-(e) for each precursor ion from the plurality of precursor ion spectra that has an intensity above the predetermined threshold in order to filter all precursor ions from the plurality of precursor ion spectra using the processor.

12. The method of claim 11, further comprising performing steps (a)-(f) as a survey scan of an information dependent acquisition (IDA) experiment and determining a list of precursor ions to fragment from the precursor ions found to originate from the ion source device using the processor.

13. The method of claim 12, further comprising instructing the mass filter to select each precursor ion of the list of precursor ions, instructing fragmentation device to fragment each precursor ion of the list of precursor ions, and instructing the mass analyzer to analyze the product ions of each precursor ion of the list of precursor ions as part of the IDA experiment using the processor.

14. A computer program product, comprising a non-transitory tangible computer-readable storage medium whose contents include a program with instructions being executed on a processor so as to perform a method for identifying precursor ions originating from an ion source device using a scanning sequential windowed precursor ion selection and mass analysis survey scan, comprising:

providing a system, wherein the system comprises one or more distinct software modules, and wherein the distinct software modules comprise a measurement module and filtering module;

instructing a mass filter to filter an ion beam received from an ion source device by scanning a precursor ion mass selection window with a width smaller than a precursor ion mass range of interest across a precursor ion mass range of interest in overlapping steps, producing a series of overlapping precursor ion mass selection windows across the precursor ion mass range, and instructing the mass filter to transmit precursor ions from each precursor ion mass selection window of the series of overlapping precursor ion mass selection windows to a mass analyzer using the measurement module, wherein the ion source device ionizes and transforms a sample into the ion beam;

instructing the mass analyzer to analyze the precursor ions of each precursor ion mass selection window of the series of overlapping precursor ion mass selection windows using the measurement module, producing a precursor ion spectrum for each overlapping precursor ion mass selection window and a plurality of precursor ion spectra for the precursor ion mass range;

receiving the plurality of precursor ion spectra from the mass analyzer using the filtering module;

selecting a precursor ion from the plurality of precursor ion spectra that has an intensity above a predetermined threshold using the filtering module;

for the selected precursor ion, retrieving the intensities of the selected precursor ion from the plurality of precursor ion spectra for at least one scan of the precursor ion mass selection window across the precursor ion mass range and produces a trace that describes how the intensity of the selected precursor ion varies with the location of the precursor ion mass selection window expressed as the precursor ion mass-to-charge ratio (m/z) of the precursor ion mass selection window as the precursor ion mass selection window is scanned across the precursor ion mass range using the filtering module; and identifying the selected precursor ion as a precursor ion originating from the ion source device if the trace includes a nonzero intensity for the m/z value of the selected precursor ion using the filtering module.

* * * * *